US012290179B2

(12) United States Patent
Fang

(10) Patent No.: US 12,290,179 B2
(45) Date of Patent: May 6, 2025

(54) BEDSIDE GUARDRAIL WITH A FOLDING TABLE BOARD

(71) Applicant: Xicheng Fang, Ningbo (CN)

(72) Inventor: Xicheng Fang, Ningbo (CN)

( * ) Notice: Subject to any disclaimer, the term of this patent is extended or adjusted under 35 U.S.C. 154(b) by 0 days.

(21) Appl. No.: 18/539,315

(22) Filed: Dec. 14, 2023

(65) Prior Publication Data

US 2025/0024958 A1 Jan. 23, 2025

Related U.S. Application Data

(63) Continuation of application No. 18/354,827, filed on Jul. 19, 2023, now Pat. No. 11,871,850.

(51) Int. Cl.
*A47C 21/08* (2006.01)
*A47B 23/02* (2006.01)

(52) U.S. Cl.
CPC ..... *A47C 21/08* (2013.01); *A47B 23/025* (2013.01); *A47B 23/02* (2013.01)

(58) Field of Classification Search
CPC ..... A47C 21/08; A47C 21/00; A47B 23/025; A47B 23/02; A47B 23/00; A61G 7/0507; A61G 7/0508; A61G 7/0509
USPC ..... 5/426, 428, 430, 425, 503.1, 507.1, 658, 5/659
See application file for complete search history.

(56) References Cited

U.S. PATENT DOCUMENTS 1,267,046 A * 5/1918 Beaird ..... A47B 5/04 5/507.1
4,357,881 A * 11/1982 De Long ..... A47B 23/02 211/88.01
6,253,399 B1 * 7/2001 Wagner ..... A47B 23/025 5/503.1
9,357,839 B1 * 6/2016 Liu ..... A47B 5/02
11,871,850 B1 * 1/2024 Fang ..... A47C 21/08

* cited by examiner

*Primary Examiner* — Robert G Santos
(74) *Attorney, Agent, or Firm* — Jose Cherson Weissbrot

(57) ABSTRACT

A bed guardrail with a folding table board, the bed guardrail comprises: a guardrail and a table board with rotating features; the guardrail includes an outer frame; the rotating feature facilitates the table board to rotate around at least one rotary axis, wherein, the direction of at least one the rotary axis is the same as the extension direction of the outer frame; the table board has a relatively flat table board surface, when the table board rotates around the rotary axis, the table board has a first position and a second position; when the table board is in the first position, the table board surface remains basically parallel to the ground, when the table board is in the second position, the support direction of the table board surface faces away from the bed body.

6 Claims, 34 Drawing Sheets

BEDSIDE GUARDRAIL WITH A FOLDING TABLE BOARD

RELATED APPLICATION

This is a Continuation-in-Part of U.S. patent application Ser. No. 18/354,827 entitled Bed rail with table having a filing date of Jul. 21, 2023, now U.S. Pat. No. 11,871,850, the contents of which is incorporated herein by reference.

TECHNICAL FIELD

The present invention relates to the technical field of bedside guardrails, in particular to a bedside guardrail with a folding table board.

BACKGROUND

In nursing scenes such as hospitals, guardrails are often set at the bedside to confine people who need nursing to the bed, so as to avoid secondary injuries caused by falling out of bed. However, most of the traditional bedside guardrails are integrated with the bed, and when guardrails are not needed, guardrails will become a great obstacle. For example, when changing sheets or mattresses, guardrails will increase the difficulty of replacement.

In the prior art, a reversible guardrail is also proposed, which can accommodate the guardrail without the block function provided by the guardrail, for example, U.S. Pat. Nos. 9,756,954, 8,104,118 and 7,784,125.

However, the guardrail disclosed above only has the function of protecting the block. In practical process, for example, when patients need to have meals in bed, they need to have meals with the help of the dining table. In order to further facilitate the nursing work, many solutions have been proposed in the prior art, such as U.S. Pat. Nos. 9,492,340 and 1,347,271A. However, the technical solutions disclosed above are cumbersome in practical use, complicated in structure and high in quality.

Although many bedside guardrails convenient for nursing work have been put forward in the prior art, users always hope to provide updated bedside guardrails, which can facilitate nursing work without affecting nursing work.

Based on the above problems, it is necessary to put forward a brand-new bedside guardrail, which has a good protection and blocking function, can confine patients to the bed, and can be conveniently and quickly accommodated by nursing workers when the blocking function of the guardrail is not needed. In addition, the guardrail also has a dining table function, which can quickly provide a support platform when patients need to have meals in bed. At the same time, the support platform has a simple structure and a low failure rate, which is further convenient for nursing work and patients to use.

SUMMARY

The present invention provides a bed guardrail with a folding table board, the bed guardrail comprises:

guardrail and table board with rotating features, and wherein, the guardrail includes an outer frame; and wherein, the rotating feature facilitates the table board to rotate around at least one rotary axis, wherein, the direction of at least one the rotary axis is the same as the extension direction of the outer frame, and wherein, the table board has a relatively flat table board surface, when the table board rotates around the rotary axis, the table board has a first position and a second position; and wherein, when the table board is in the first position, the table board surface remains basically parallel to the ground, when the table board is in the second position, the support direction of the table board surface faces away from the bed body.

The present invention also provides a bed guardrail with a folding table board, the bed guardrail comprises:

a guardrail, a table board and at least one rotary module; and wherein, the rotary module can be engageable by the guardrail and the table board, and facilitates the table board to rotate around at least one rotary axis, wherein, the rotary module includes at least one part with a curved surface; and wherein, the guardrail includes an outer frame; and wherein, at least one the rotary axis is in the same direction as the extension direction of the outer frame.

The present invention also provides a method of using a device to achieve a user's daily work life on a bed, the method comprises the following steps:

provide the device, the device includes a guardrail and a table board with a jointing device; and wherein, the guardrail includes an outer frame; and wherein, the jointing device can be detachably attached to the outer frame; and install the guardrail on the bed body; and install the table board on the outer frame; and use the device for daily work life.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the detailed description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the Figures.

Figure 1:
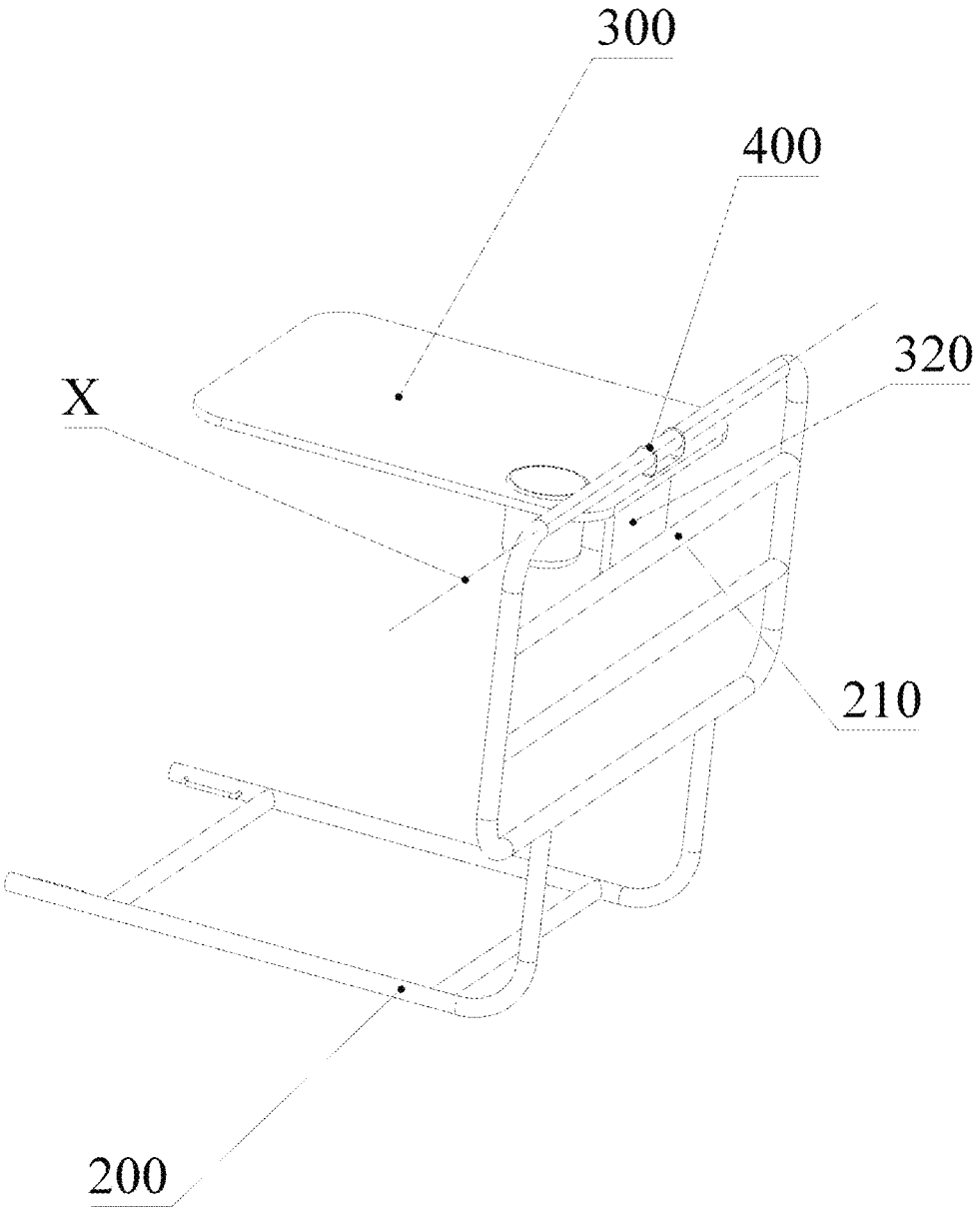
FIG. 1 is a schematic view of a table board in a first position.

bed body (100); mattress (110); guardrail (200); inner extension arm (210); outer frame (220); horizontal pipe (221); vertical pipe (222); rounded corner (223); fixed end (230); bending part (231); long straight section (232); retaining device (233); upper section (234); lower section (235); rotating mechanism (240); rotating shaft (241); fixing pin (242); table board (300); table board surface (310); rotation restricting part (320); retaining lip (330); cup holder (340); pivot member (400); central opening (410); fixing device (420); threaded hole (430); multi-axis rotating device (500); first axis (X); second axis (Y); rotating surface (550); rotating structure (560); rotary module (600); guardrail connecting module (610); buckle part (611); limiting part (612); locking mechanism (613); locking member (614); table top connecting module (620); cross bar (622); storage cavity (623); extension rod (624); angle adjusting mechanism (630); control device (640); control end (641); limiting end (642); adjusting rod (650); locking end (651); free end (652); jointing device (660); rotary axis (L).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. May be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or laver, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Figure 2:
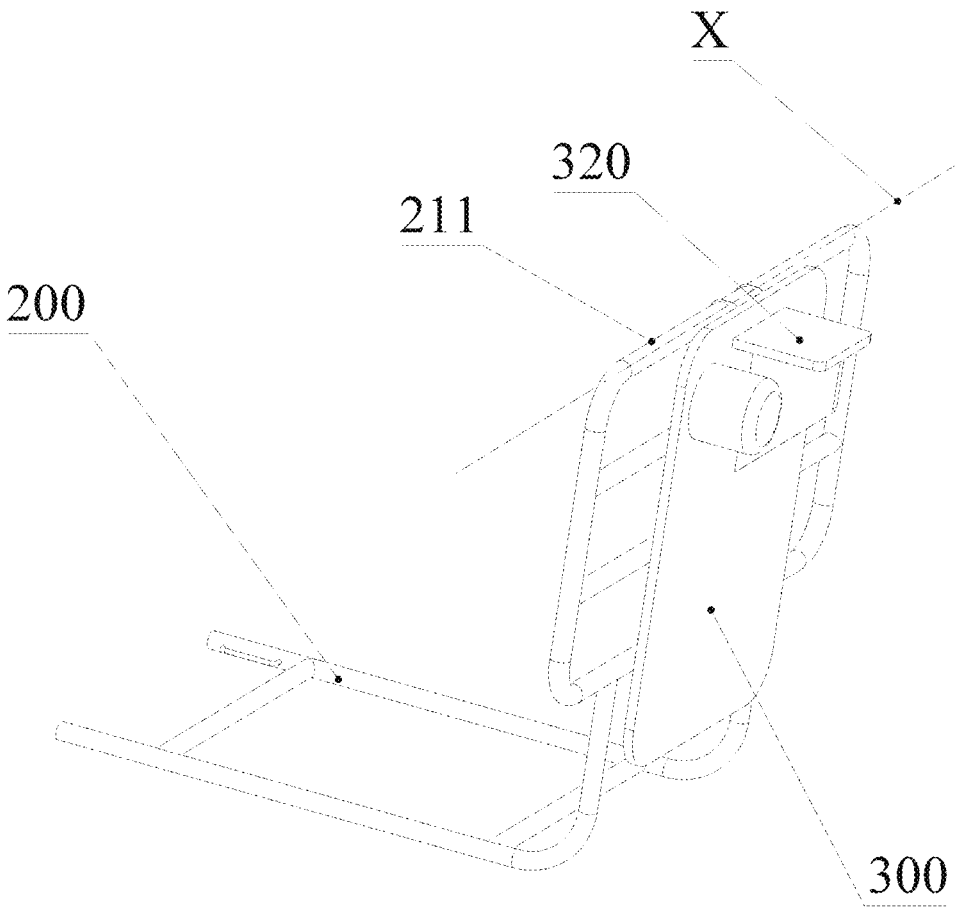
FIG. 2 is a schematic view of the table board in a second position.

As shown in FIGS. 1 and 2, the present invention provides a bed rail with table, including a guardrail 200 and a table board 300.

Figure 4:
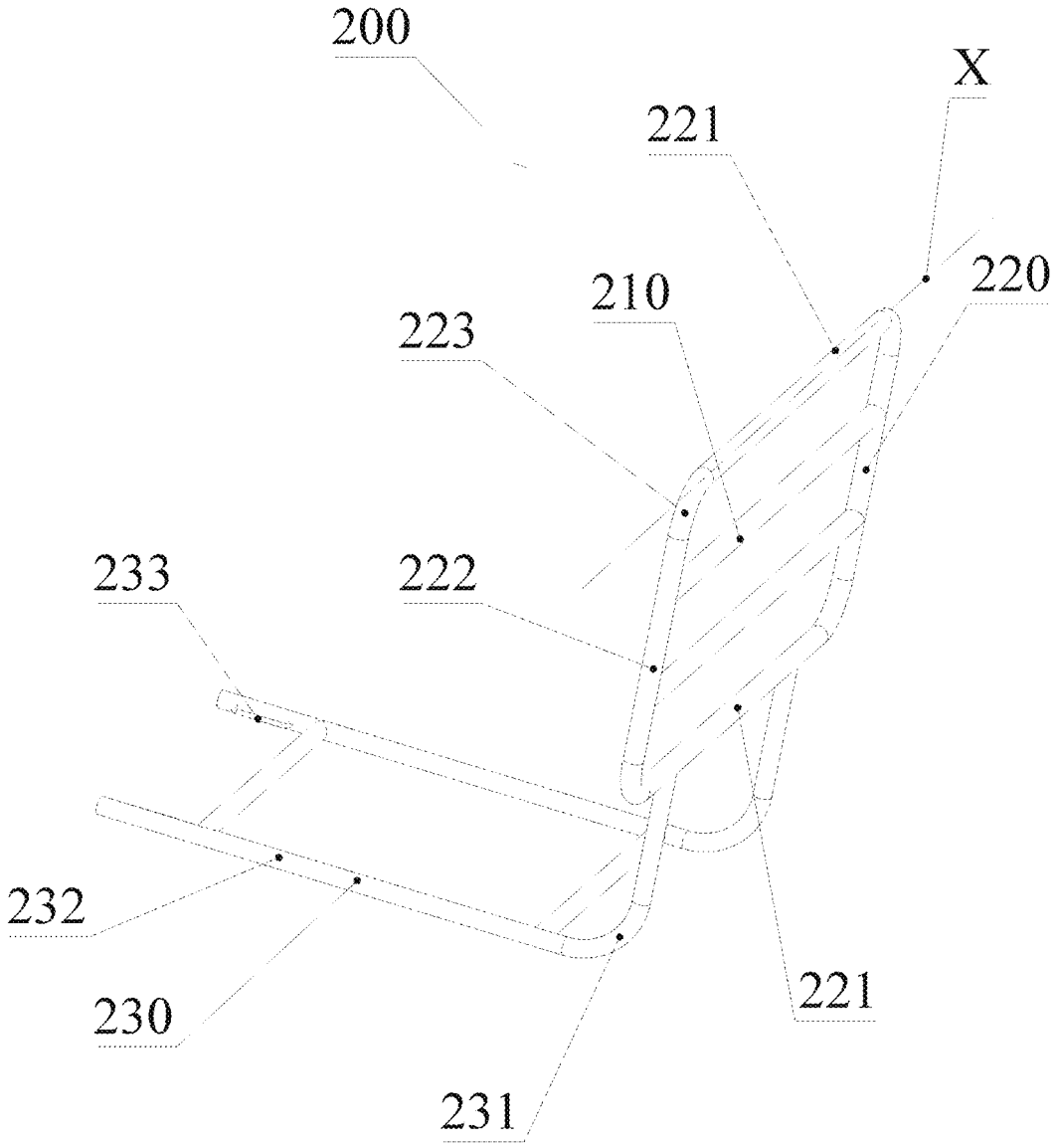
FIG. 4 is a schematic diagram of a guardrail.

As shown in FIG. 4, the guardrail 200 is composed of an outer frame 220 with an inner extension arm 210 and a fixed end 230 that can be attached to the bed body 100, wherein the outer frame 220 is configured to form a block for patients on the bed body 100, which defines a substantially flat blocking plane, and the inner extension arm 210 extends from the outer frame 220 and extends on the blocking plane.

Specifically, the outer frame 220 is generally rectangular, which is formed by connecting two parallel horizontal pipes 221 and two parallel vertical pipes 222 end to end, wherein the horizontal pipes 221 and the vertical pipes 222 are configured to have cylindrical surfaces, so that users can grasp them more easily. In some embodiments (not shown in the figure), in order to further facilitate users' grasping, the outer surfaces of the horizontal pipes 221 and the vertical pipes 222 are also provided with anti-skid lines or anti-skid bumps, in order to further increase the friction between the user and the outer frame 220 of the guardrail 200 when grasping, and reduce the risk of the user's palm falling off the outer frame 220 when grasping.

In this embodiment, the outer frame 220 is integrally formed, and the joint of the horizontal pipe 221 and the vertical pipe 222 is configured with a rounded corner 223, which can effectively avoid the danger brought by the right angle to the user, and the shape of the rounded corner 223 is also easier for the user to grasp. In some embodiments, the outer frame 220 can also be formed by assembly, for example, the horizontal pipe 221 and the vertical pipe 222 are assembled into a substantially rectangular outer frame 220 by using fillet connectors (not shown in the figure).

Figure 5:
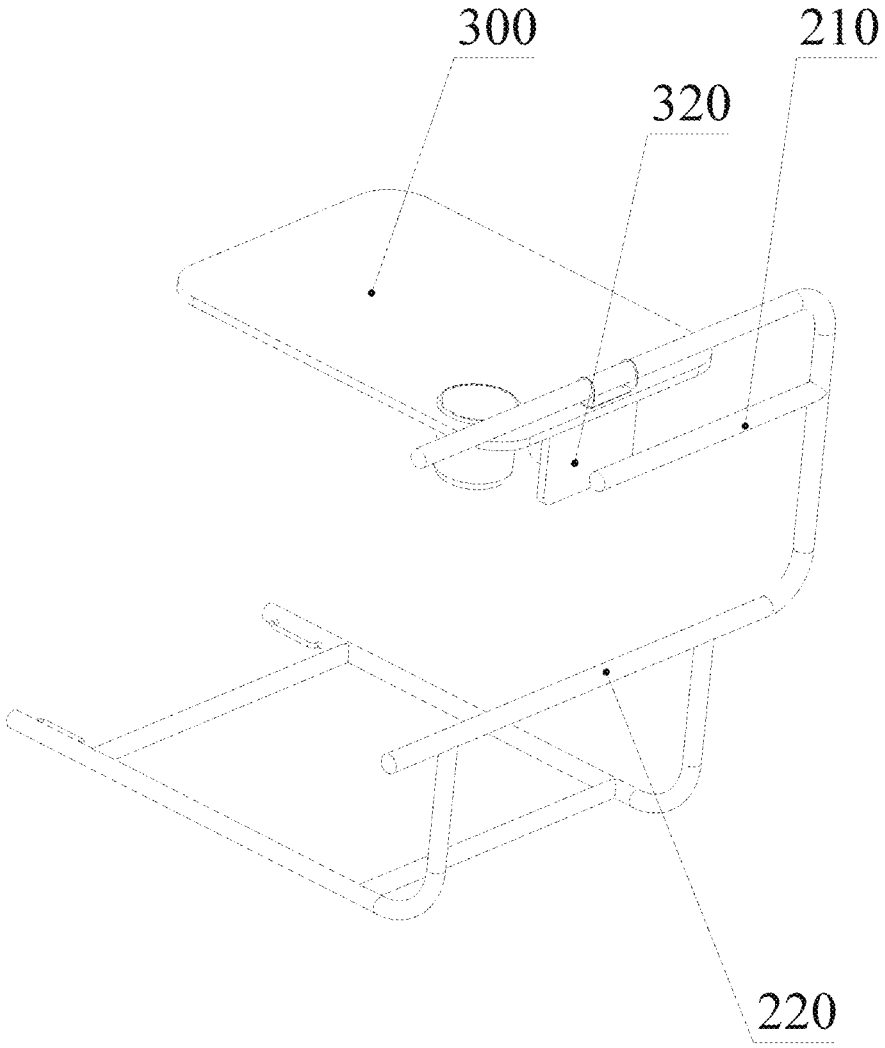
FIG. 5 is another schematic view of the guardrail.

In other embodiments, the outer frame 220 is not limited to the rectangular outer contour. In order to further reduce the manufacturing cost or provide users with more choices, the outer contour of the outer frame 220 can also be triangular, rectangular or any other desired geometric shape. In some embodiments (see FIG. 5), the outer frame 220 may also have at least one opening.

Figure 3:
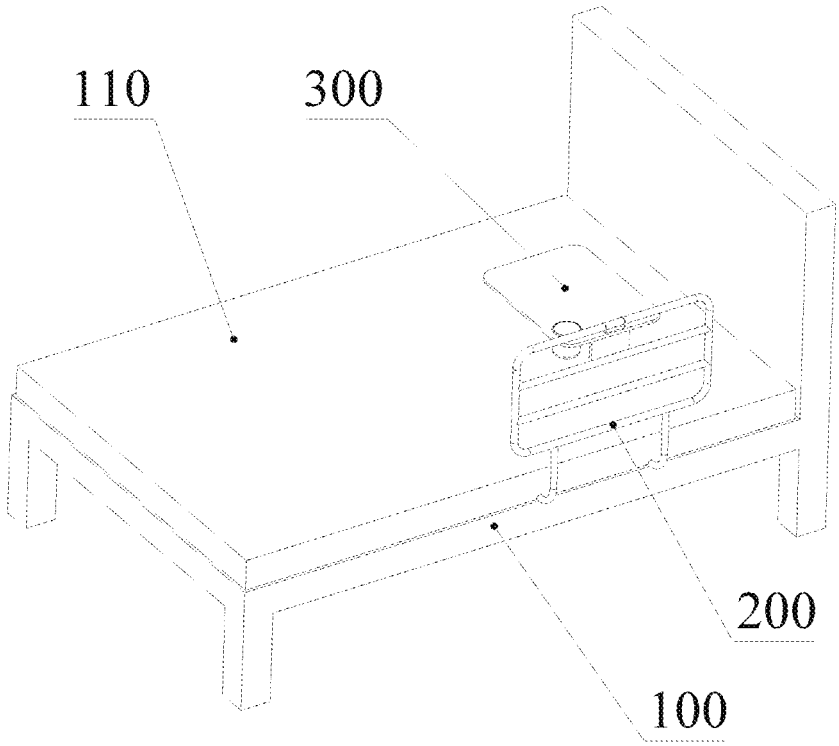
FIG. 3 is a schematic diagram of the bedside guardrail of the present invention installed on the bed body.

As shown in FIGS. 3 and 4, the fixed end 230 is configured to be detachably attached to the bed body 100. as a preferred embodiment of the present invention, the fixed end 230 extends from the lower edge of the outer frame 220 and has a bending part 231 with a bending angle of 90 degrees, and the fixed end 230 continues to extend through the bending part 231, so that the fixed end 230 has a long straight section 232 that remains basically vertical to the outer frame 220. the long straight section 232 is provided with a retaining device 233 to form a detachable connection with the bed body 100. in this embodiment, the connection mode is a fastening connection. Specifically, the bed body 100 is provided with a fastening part. The retaining device 233 receives the fastening action of the fastening part and holds the fixed end 230 on the bed body 100. when the bedside guardrail needs to be detached from the bed body 100, it is only necessary to unlock the fastening part from the holding device 233, and the detachment action can be completed. In this embodiment, the fastening part adopts a conventional fastening element. In some embodiments, the connection mode can also adopt threaded connection.

Figure 6:
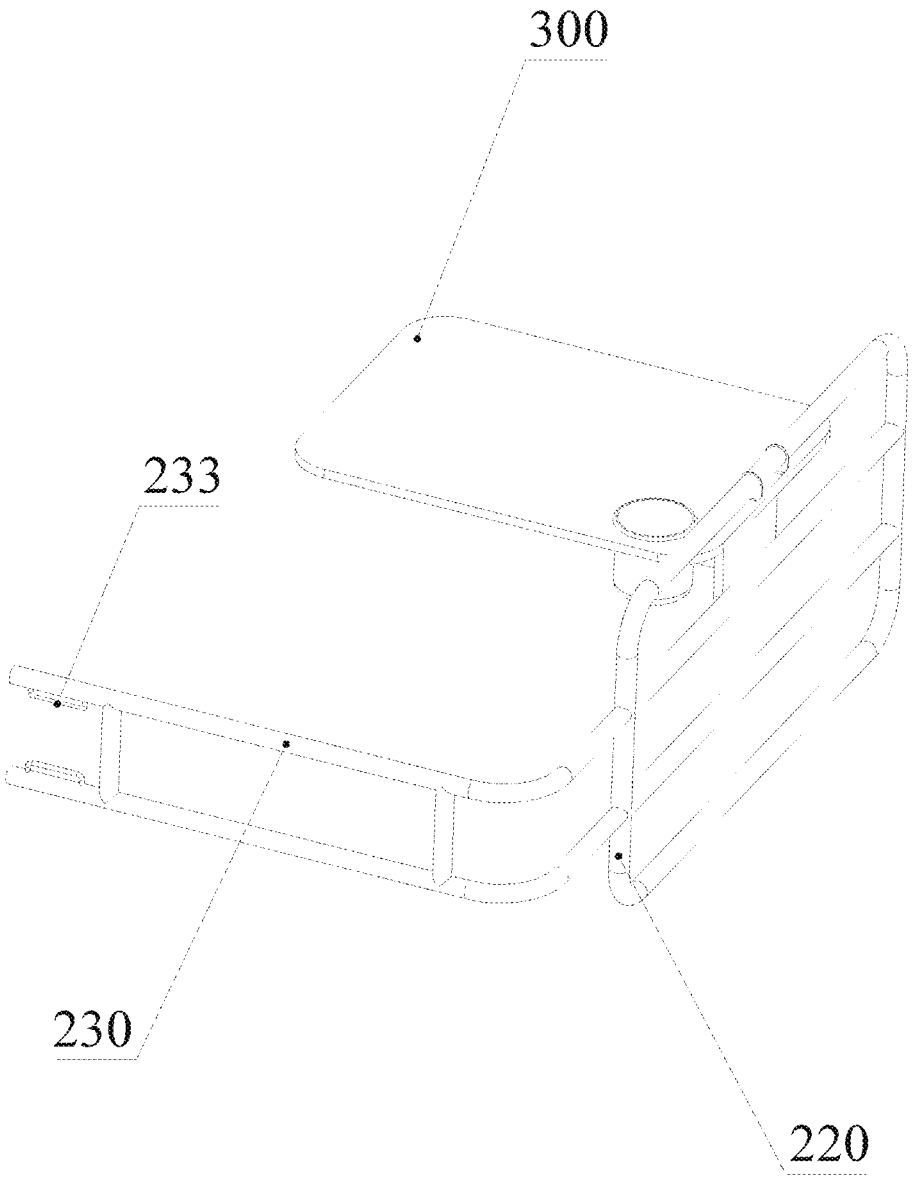
FIG. 6 is another schematic view of the guardrail.
Figure 7:
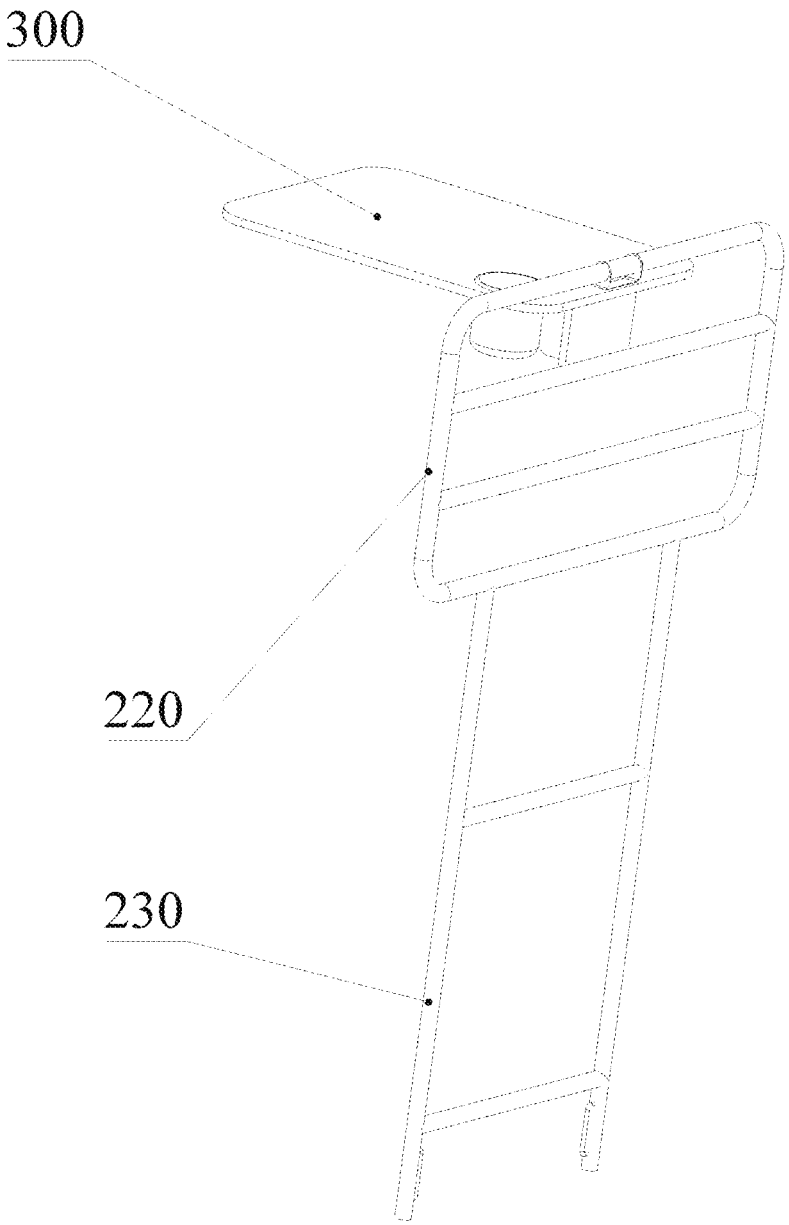
FIG. 7 is another schematic view of the guardrail.

In other embodiments (see FIG. 6), in order to be used in more scenes, the fixed end 230 can also extend from the side of the outer frame 220. in some embodiments (see FIG. 3), a mattress 110 can be directly pressed against the long straight section 232 of the fixed end 230, and the bedside guardrail can be fixed by the gravity of the mattress 110. in some embodiments (see FIG. 7), the fixed end 230 is not provided with a bending part 231, but directly extends out to form a long straight section 232 and is detachably attached to the bed body 100 through the long straight section 232. in the preferred embodiment of the present invention, the fixed end 230 is integrally formed with the outer frame 220, and in some embodiments, the fixed end 230 can also be assembled with the outer frame 220 through connectors.

Figure 8:
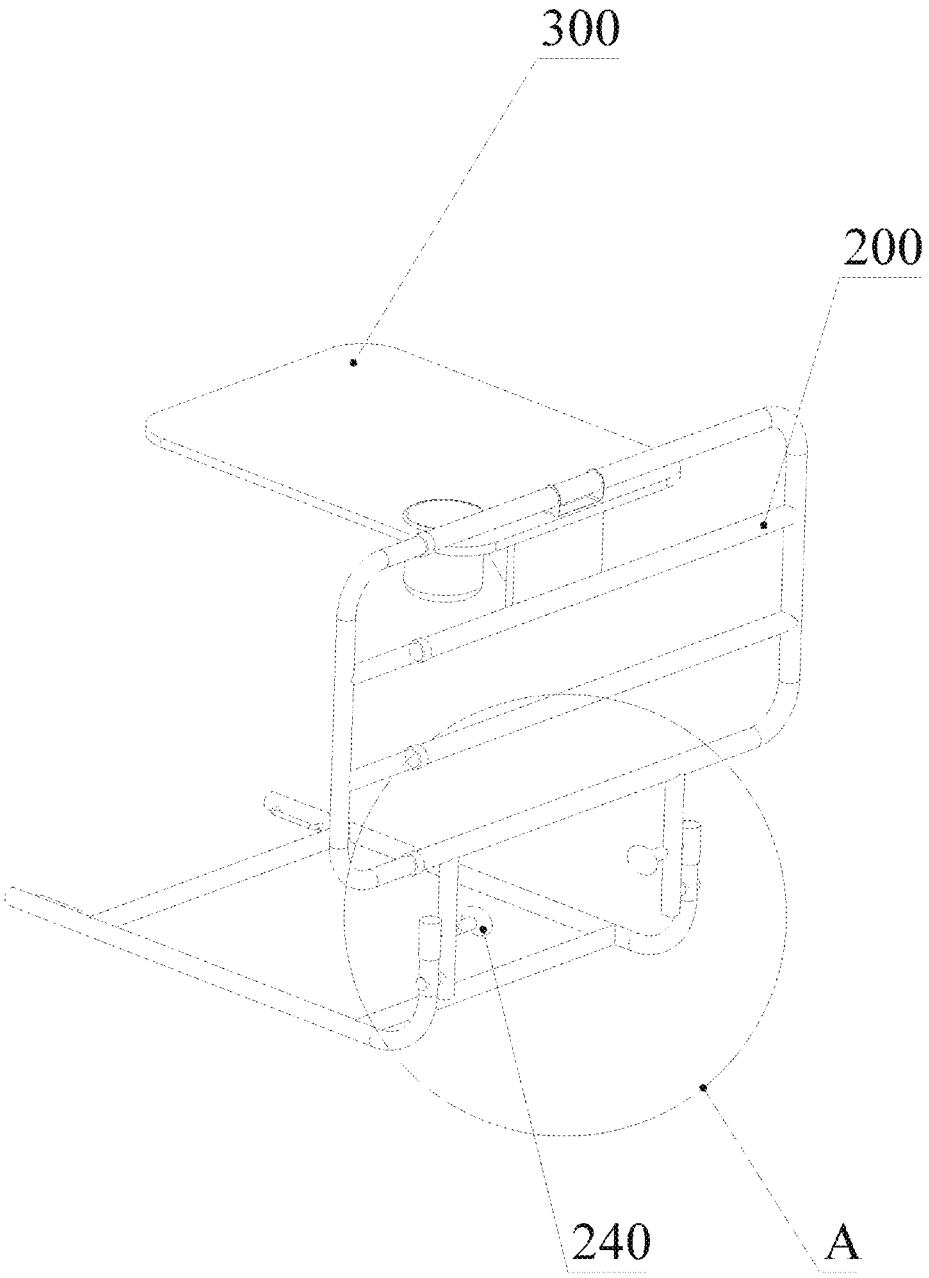
FIG. 8 is another schematic view of the guardrail.
Figure 9:
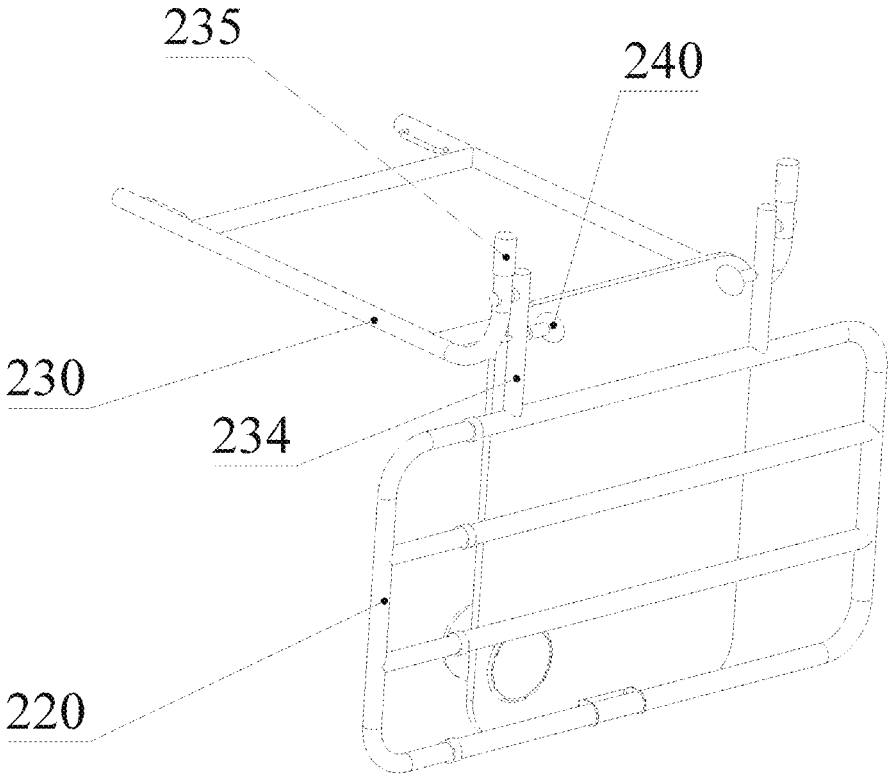
FIG. 9 is another schematic view of the guardrail.

In some embodiments, as shown in FIGS. 8 and 9, the outer frame 220 further includes a rotating mechanism 240, and the outer frame 220 can be switched between the blocking state and the opening state by using the rotating mechanism 240, so that the user can contact the blocking of the bedside guardrail on the bed body 100 without disassembling the bedside guardrail, and it is convenient for the nursing staff to replace the sheets or bed body 100.

Figure 10:
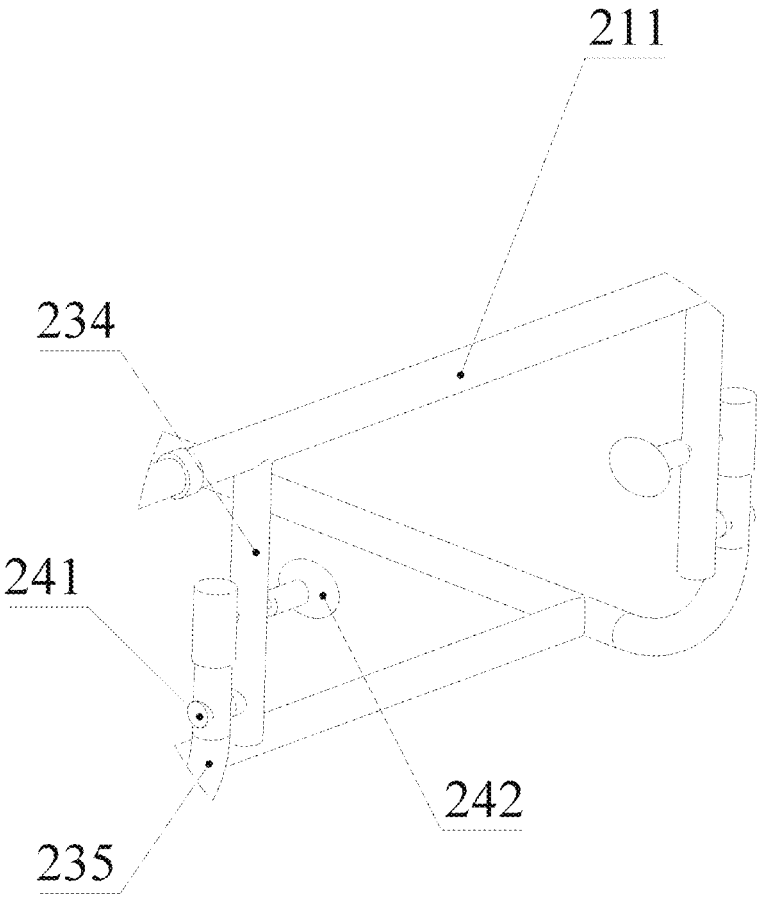
FIG. 10 is a schematic view at A in FIG. 8.
Figure 11:
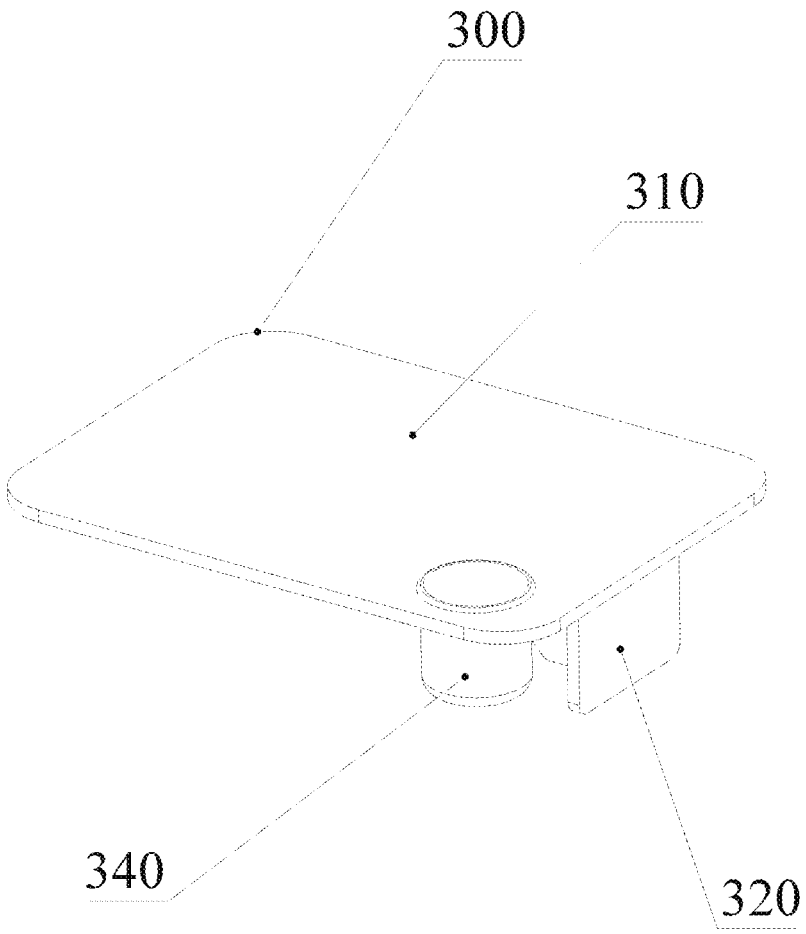
FIG. 11 is a schematic diagram of a table board.

Specifically, as shown in FIG. 10, the fixed end 230 includes an upper section 234 and a lower section 235, and the rotating mechanism 240 includes a rotating shaft 241 and a fixing pin 242. both the upper section 234 and the lower section 235 are provided with a through hole for the rotating shaft 241 to pass through and a pin hole for the fixing pin 242 to insert, wherein the rotating shaft 241 is fixedly arranged in the through holes of the upper section 234 and the lower section 235 to connect the upper section 234 and the lower section 235. when the outer frame 220 needs to block the bed body 100, the fixing pin 242 is inserted into the pin holes of the upper section 234 and the lower section 235 to maintain the blocking state of the outer frame 220. when it needs to contact the blocking state, the fixing pin 242 can be pulled out, wherein the fixing pin 242 can be fixedly inserted into any pin hole of the upper section 234 or the lower section 235, or one end of the fixing pin 242 can be fixed with the outer frame 220 through a rope, which is convenient for users to use the fixing pin 242 quickly, and at the same time effectively prevents the loss of the fixing pin 242. in some embodiments (not shown in the figure), the upper section 234 and the lower section 235 may be additionally provided with a fixing hole to keep the outer frame 220 open relative to the bed body 100.

In some embodiments (not shown in the figure), the rotating mechanism 240 can also have other configurations, for example, the rotation of the outer frame 220 can have more adjustment angles through gears to meet other use requirements of users. In some embodiments (not shown in the figure), the rotating shaft 241 can also be configured as a damping shaft to reduce the wear during rotation and improve the service life.

In order to facilitate patients to have meals in bed, as shown in FIGS. 1, 4, 11 and 12, the bedside guardrail provided by the present invention further includes a table board 300, which includes a relatively flat table board surface 310 and a rotation restricting part 320 pivotally attached to the outer frame 220 to rotate between a first position and a second position around a first axis X, wherein the rotation restricting part 320 extends from the table board 300 along a direction opposite to the supporting direction of the table board surface 310.

As a preferred embodiment of the present invention, as shown in FIG. 1, FIG. 2 and FIG. 4, the upper horizontal pipe 221 of the outer frame 220 with a substantially rectangular shape defines a first axis X, and the table board 30) is pivotally attached to the upper horizontal pipe 221 to be rotationally switched between a first position in a use state and a second position in a storage state around the first axis X.

As shown in FIG. 1, when the table board 300 pivots around the first axis X and is in the first position, the rotation restricting part 320 ends on the blocking plane, and the table board surface 310 remains substantially parallel to the ground; when the table board 300 pivots around the first axis X and is in the second position, the supporting direction of the table board surface 310 faces away from the bed body 100. specifically, as shown in FIG. 4, the inner extension arm 210 extends from the outer frame 220 and on the blocking plane. When the table board 300 is in the first position, the rotation restricting part 320 abuts on the inner extension arm 210, which blocks the table board 300 and restricts the further rotation of the table board 300. at this time, the table board surface 310 remains basically parallel to the ground, which is convenient for users to eat on the table board 300.

Figure 13:
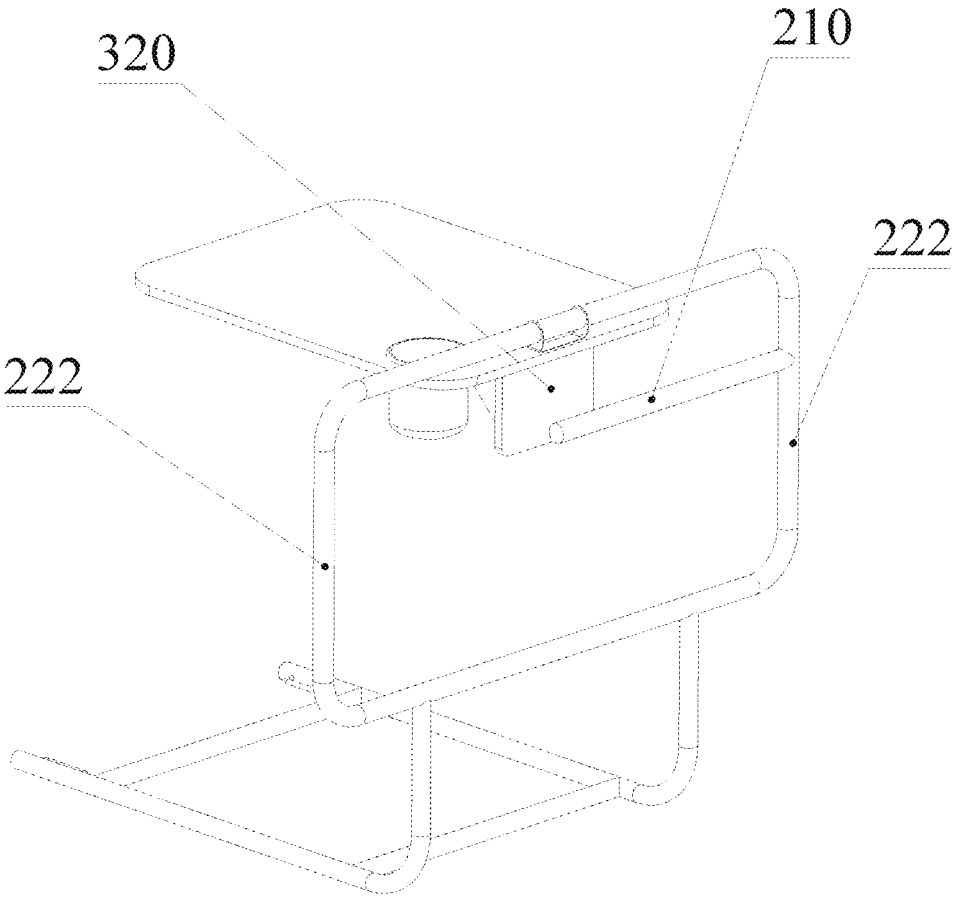
FIG. 13 is another schematic view of the inner extension arm.
Figure 14:
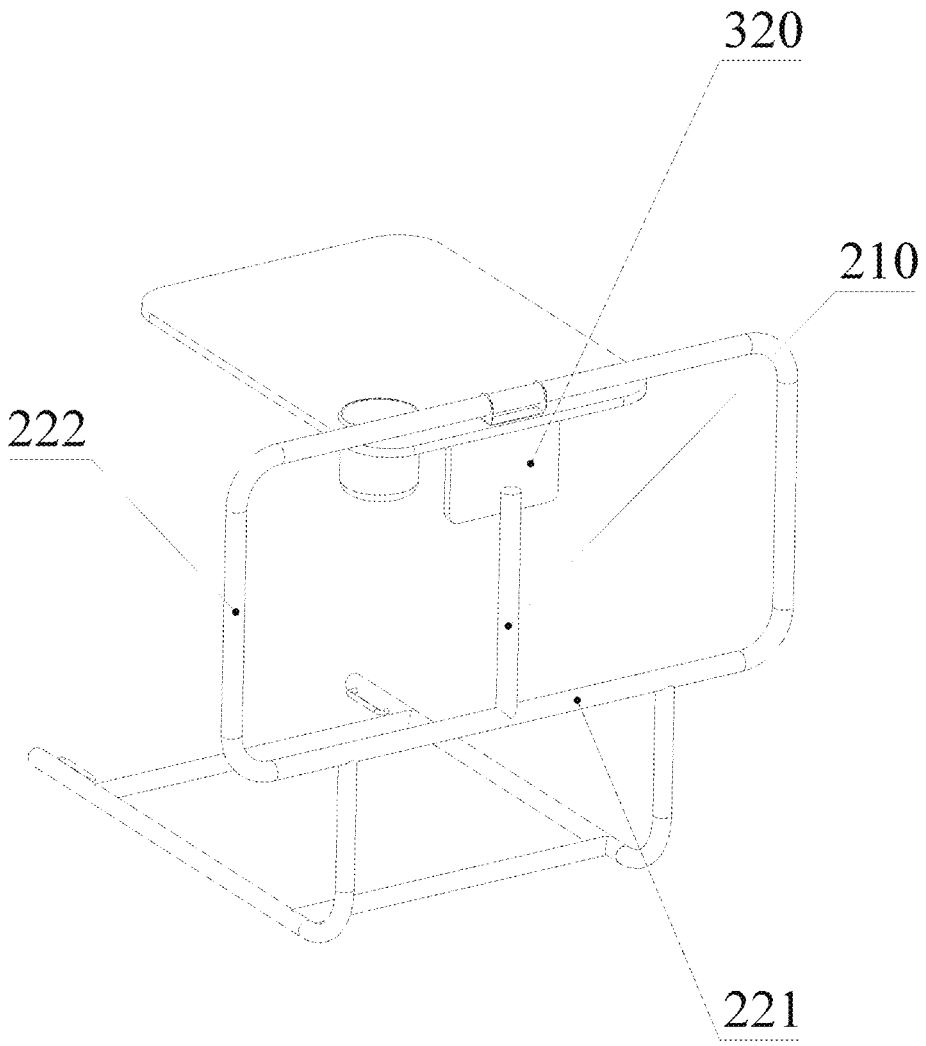
FIG. 14 is another schematic view of the inner extension arm.
Figure 15:
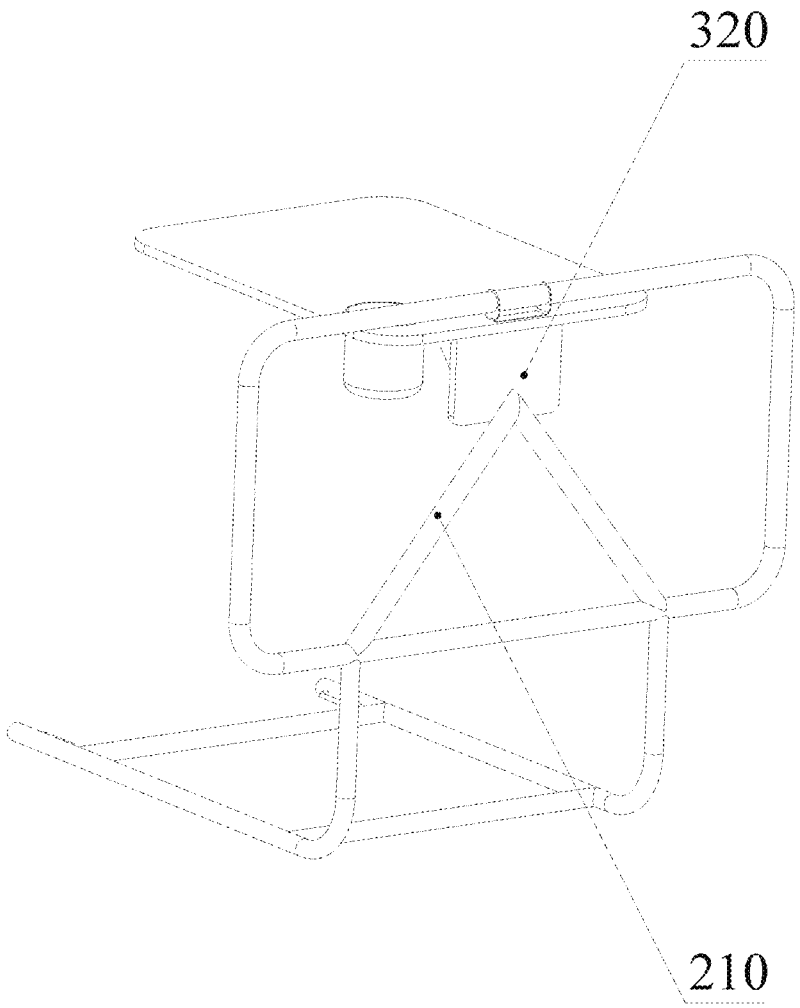
FIG. 15 is another schematic view of the inner extension arm.

In this embodiment, the inner extension arm 210 protrudes from the vertical pipe 222 of the outer frame 220 and extends on the blocking plane, and is finally connected with another vertical pipe 222, and its extension position is preferably configured such that when the rotation restricting part 320 approaches and reaches the blocking plane, the inner extension arm 210 can just abut against the rotation restricting part 320 and form a block. In some embodiments, the inner extension arm 210 can extend in other ways. As shown in FIG. 13, the inner extension arm 210 extends from the vertical pipe 222 but is not connected with another vertical pipe 222, as shown in FIG. 14, the inner extension arm 210 extends from the horizontal pipe 221, and its extension position can also abut against the rotation restricting part 320. as shown in FIG. 15, in order to meet the user's use requirements, the extension mode of the inner extension arm 210 can also have a shape, so that the outer frame 220 forms a stronger block to the bed body 100. in other embodiments, the inner extension arm 210 has any desired extension mode, as long as it can abut against and block the rotation restricting part 320.

Figure 12:
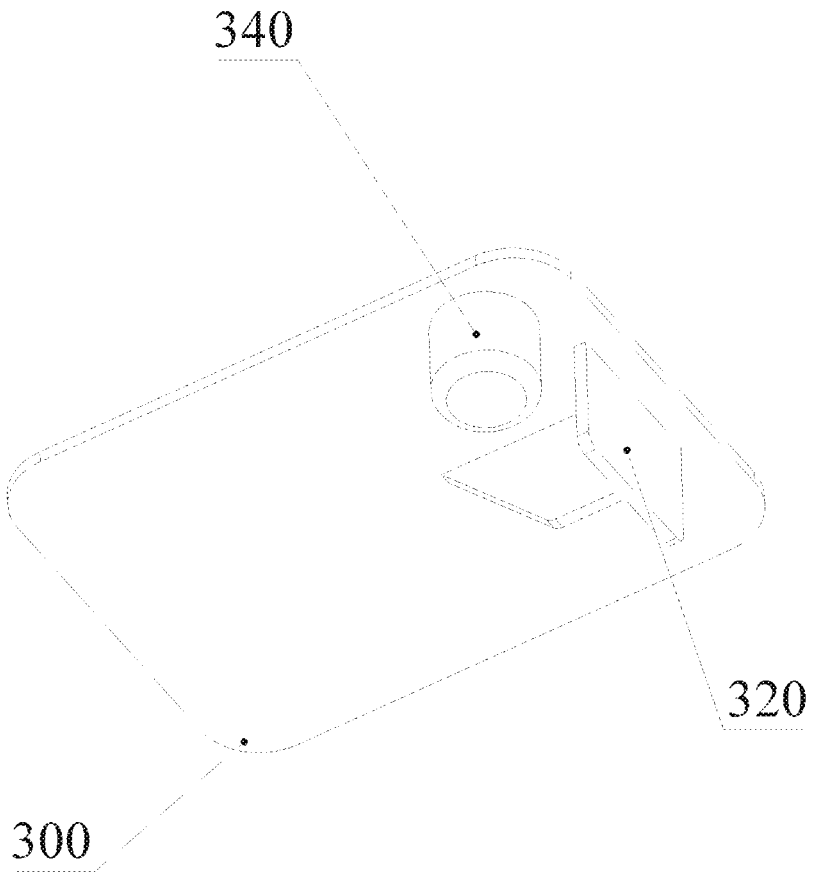
FIG. 12 is another schematic view of the table board.
Figure 16:
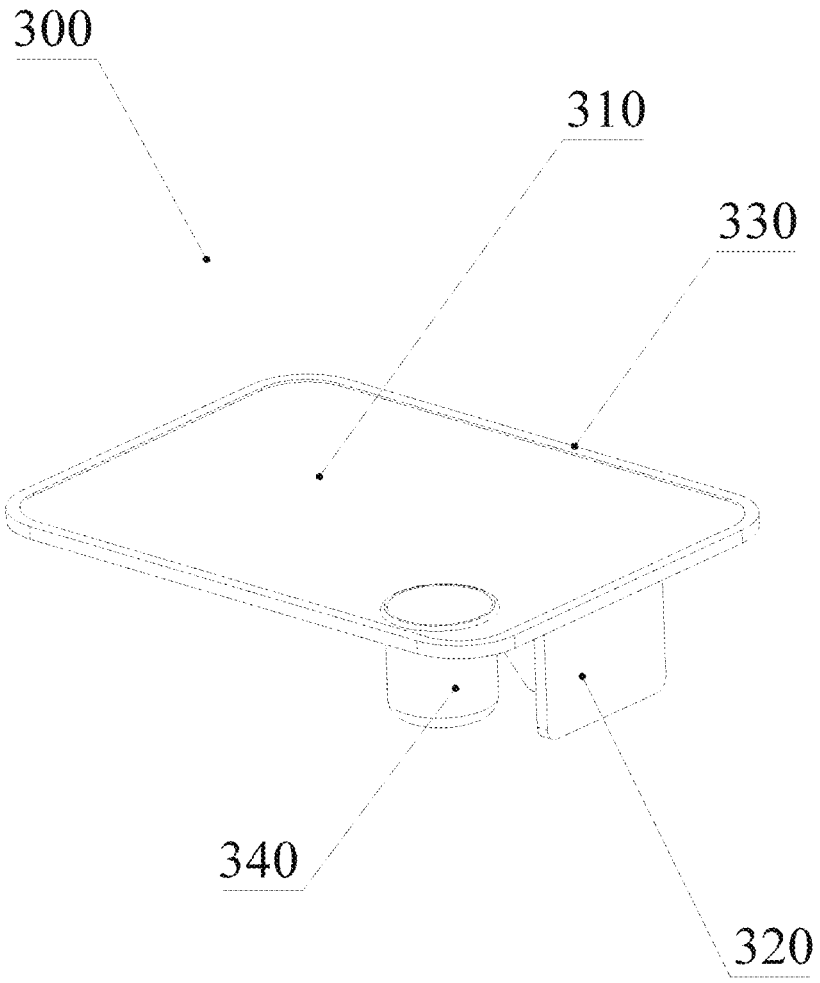
FIG. 16 is another schematic view of the table board.

In some embodiments, as shown in FIG. 16, in order to further facilitate the dining of users, the table board 300 further includes a retaining lip 330, which is continuously formed around the outer periphery of the table board 300 and protrudes upward along the supporting direction of the table board surface 310. as shown in FIG. 12, the table board 300 is also provided with a cup holder 340, which is convenient for users to place cups or other tableware.

In this embodiment, the retaining lip 330 has a height difference of 1 cm relative to the table board surface 310, so that the retaining lip 330 can effectively limit the tableware on the table board surface 310, prevent it from falling, and further facilitate the dining of users. In some embodiments (not shown in the figure), in order to further improve the restraining effect on tableware, the retaining lip 330 may have a higher restraining height. In some embodiments (not shown in the figure), in order to meet the user's use requirements, the retaining lip 330 formed continuously around the outer periphery of the table board 300 may have uneven protruding heights, and the retaining lip 330 has a roughly wavy shape. In some embodiments (not shown), in order to clean the table board surface 310 conveniently after eating, the retaining lip 330 can also be provided with an opening to provide a passage for dining stains left on the table board surface 310 to leave the table board surface 310. in some embodiments (not shown in the figure), the table board surface 310 is further provided with anti-slip lines to further limit the sliding of tableware on the table board surface 310.

Figure 17:
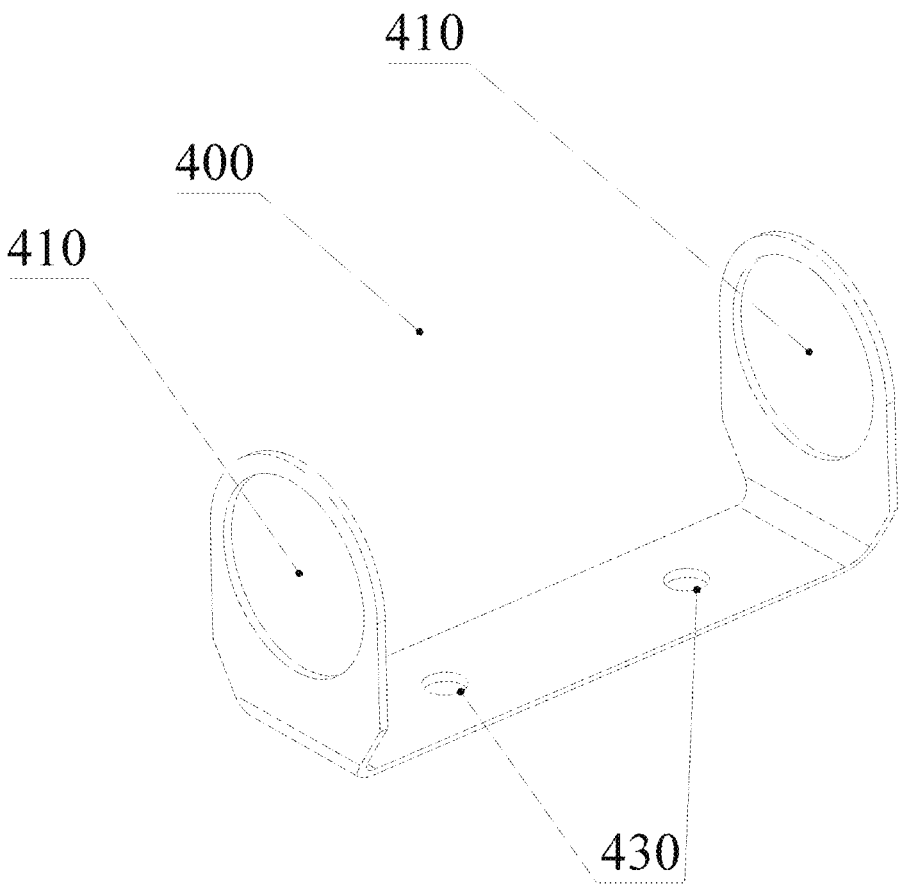
FIG. 17 is a schematic view of a pivot member.

As shown in FIGS. 1 and 17, the table board 300 of the present invention is attached to the outer frame 220 through a pivot member 400 to rotate between a first position and a second position around a first axis X. Specifically, the pivot member 400 has a central opening 410 that accommodates the outer frame 220, and the pivoting axis of the pivot member 400 coincides with the first axis X.

In this embodiment, the pivot member 400 penetrates the upper horizontal pipe 221 of the outer frame 220, and the pivot member 400 can slide back and forth on the upper horizontal pipe 221, so that the pivoting axis of the pivot member 400 coincides with the first axis X. The pivot member 400 is also provided with a threaded hole 430, which forms a detachable connection with the table board 300 in a threaded manner. When a user needs to replace the table board 300, the pivot member 400 can be connected through this connection. In some embodiments (not shown in the figure), the connection mode can also adopt fastening connection.

Figure 18:
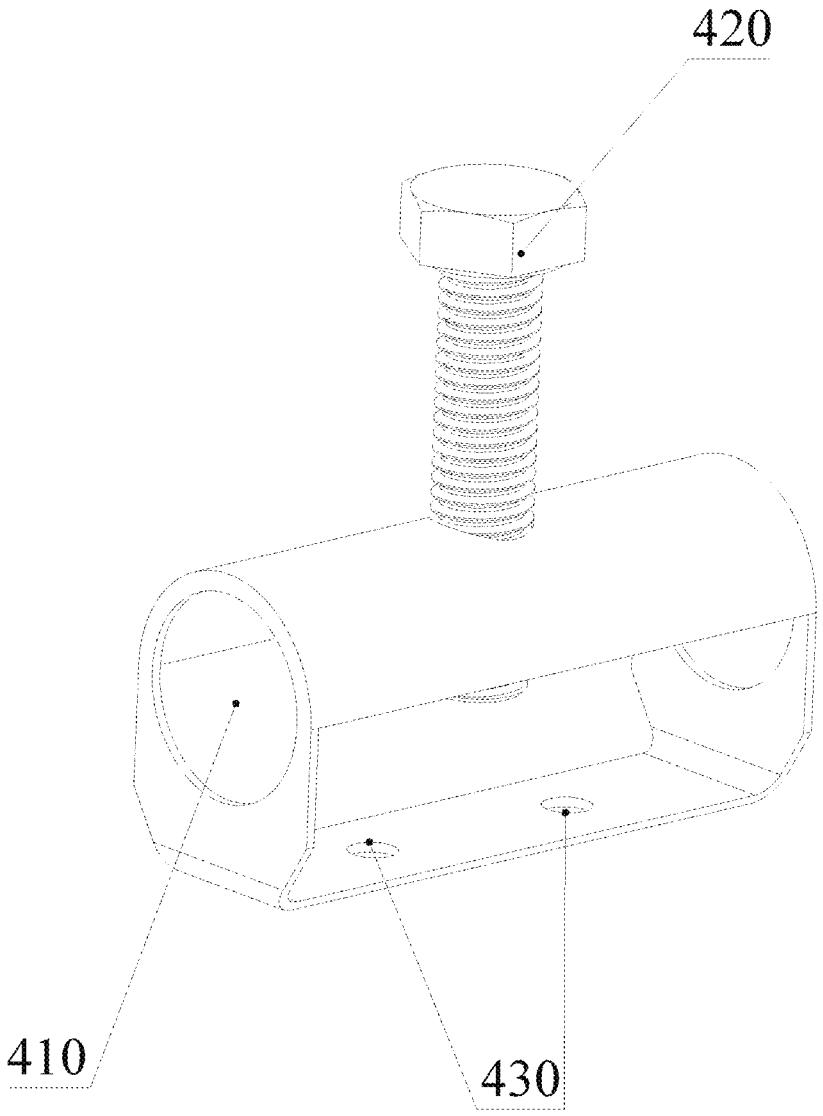
FIG. 18 is another schematic view of the pivot member.

In some embodiments, as shown in FIG. 18, the pivot member 400 is further provided with a fixing device 420, and the fixing device 420 forms a fastening connection with the outer frame 220 to keep the pivot member 400 on the outer frame 220. in this embodiment, the fixing device 420 is in the form of a screw. When it is necessary to keep the pivot member 400 in one position, the screw is butted against the outer frame 220, so that a fastening connection is formed between the screw and the outer frame 220. when it is necessary to adjust the position of the pivot member 400 and then adjust the horizontal position of the table board 3M) relative to the outer frame 220, it is only necessary to loosen the screw. In some embodiments (not shown in the figure), the fixing device 420 may also take the form of a fastener, and the pivot member 400 is held and fixed on the outer frame 220 by the fastening of the fastener. In some embodiments (not shown in the figure), the fixing device 420 can also take the form of magnet attraction.

Figure 19:
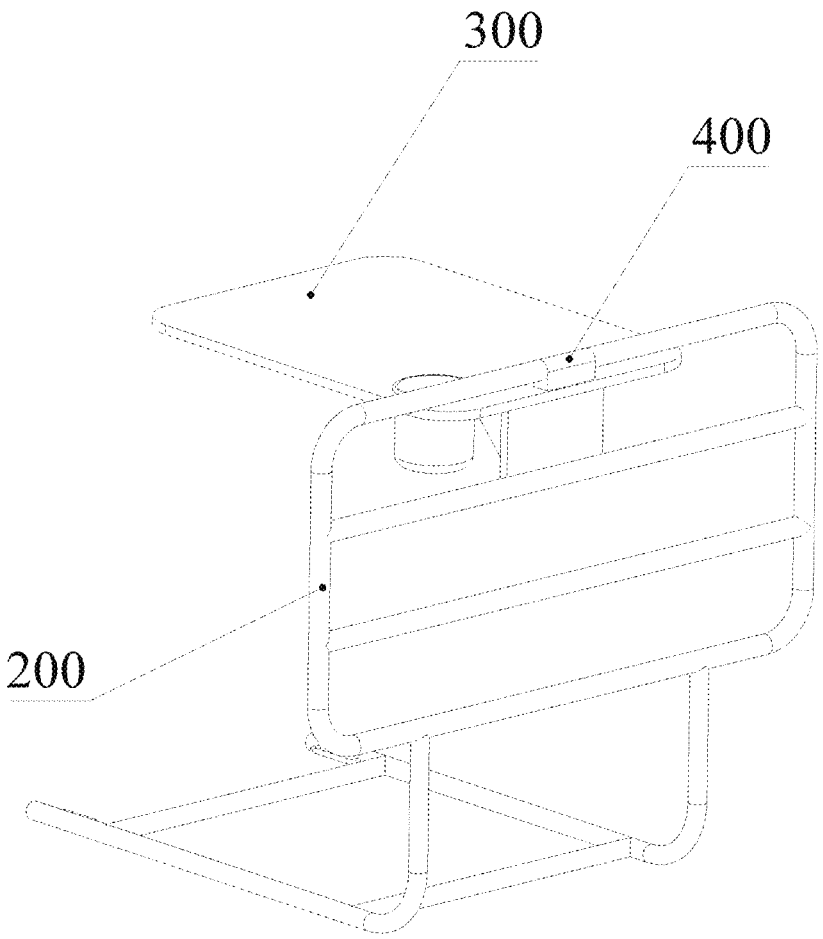
FIG. 19 is another schematic view of the pivot member.

In other embodiments, as shown in FIG. 19, the pivot member 400 has the same outer diameter as the horizontal pipe 221 of the outer frame 220. specifically, the pivot member 400 is fixedly arranged on the horizontal pipe 221 without the central opening 411, and its pivoting axis is arranged in the horizontal pipe 221, so that the table board 300 can rotate more stably when switching between the first position and the second position by the pivot member 400.

Figure 20:
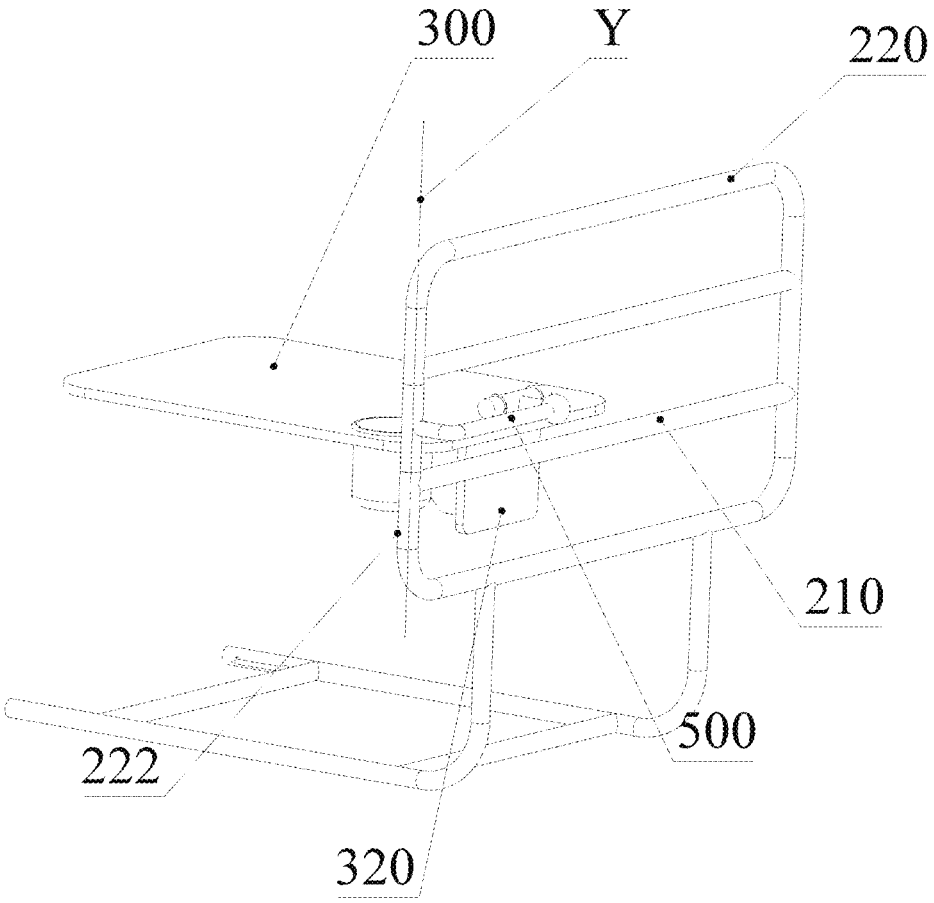
FIG. 20 is a schematic diagram of a table board in a first position according to another embodiment of the present invention.
Figure 21:
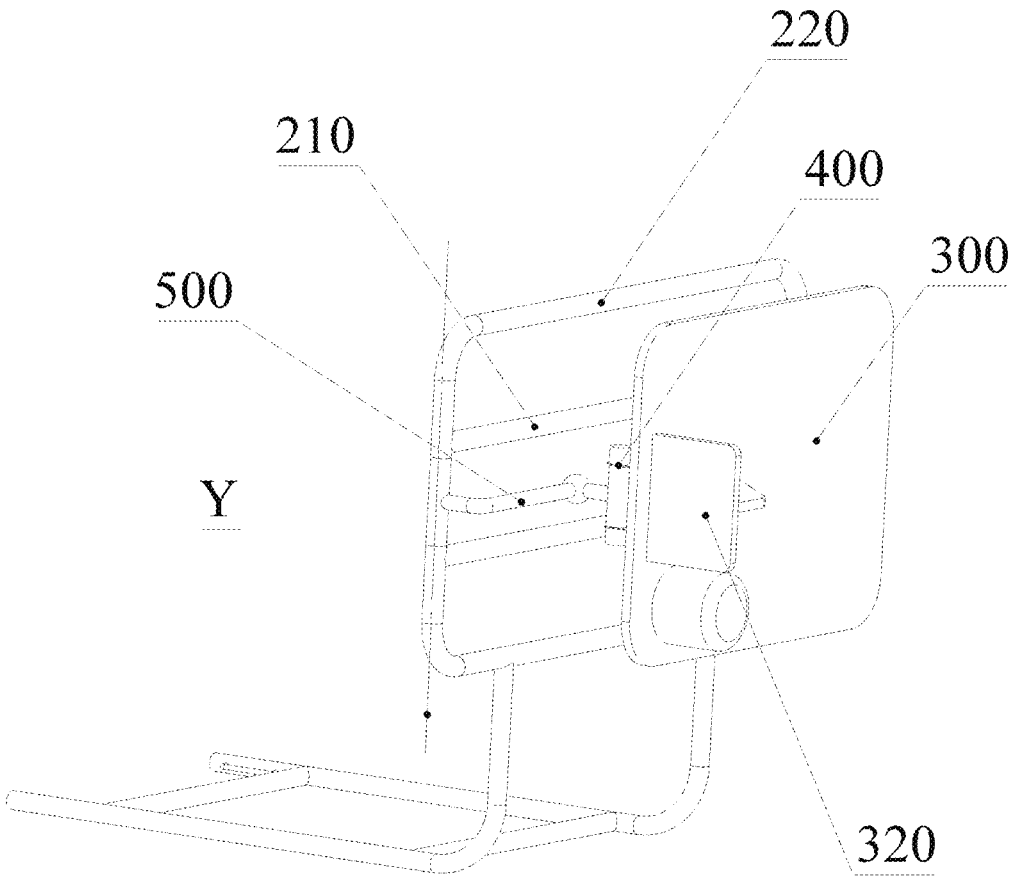
FIG. 21 is a schematic view of a table board in a second position according to another embodiment of the present invention.

In another embodiment of the present invention, as shown in FIGS. 20 and 21, the present invention simultaneously provides a bed rail with table, including a guardrail 200 and a table board 300, wherein the guardrail 200 is composed of an outer frame 220 with an inner extension arm 210 and a fixed end 230 that can be attached to the bed body 100, and the outer frame 220 defines a substantially flat blocking plane, and the inner extension arm 210 protrudes from the outer frame 220.

The table board 300 includes a relatively flat table board surface 310 and a rotation restricting part 320 pivotally attached to the outer frame 220 to rotate between a first position and a second position around the second axis Y, wherein the rotation restricting part 320 extends from the table board 300 in a direction substantially opposite to the supporting direction of the table board surface 310.

When the table board 300 pivots around the second axis Y and is in the first position, the rotation restricting part 320 ends on the blocking plane, and the table board surface 310 remains substantially parallel to the ground; when the table board 300 pivots around the second axis Y and is in the second position, the supporting direction of the table board surface 310 faces away from the bed body 100.

In this embodiment, the vertical pipe 222 of the substantially rectangular outer frame 220 defines the second axis Y. The table board 300 rotates around the second axis Y and has a first position in a use state and a second position in a storage state.

In order to make the table board 300 switch between the first position and the second position around the second axis Y smoother and more stable, as shown in FIGS. 20 and 21, the present invention also provides a multi-axis rotating device 500. specifically, one end of the multi-axis rotating device 500 is rotatably connected with the vertical pipe 222 of the outer frame 220, and the other end is detachably attached to the table board 300. in this embodiment, one end of the multi-axis rotating device 500 is configured to be received by the pivot member 400, and the table board 300 rotates around the second axis Y through the multi-axis rotating device 500 between the first position and the second position.

In this embodiment, the multi-axis rotating device 500 is preferably configured to have three rotational degrees of freedom, and in other embodiments, the multi-axis rotating device 500 may also have other numbers of rotational degrees of freedom.

Referring to FIGS. 22 to 34, as another preferred embodiment of this invention application, this invention application provides a bed guardrail with a folding table board, said bed guardrail includes a guardrail 200, a table board 300 and a rotary module 600.

The guardrail 200 is composed of an outer frame 220 with an inner extension arm 210 and a fixed end 230 that can be attached to the bed body 100, wherein, the outer frame 220 is configured to form a barrier to the patient on the bed body 100, it defines a basically flat blocking plane, the inner extension arm 210 extends from the outer frame 220 and extends on the blocking plane. Part of the structure of the guardrail 200 is a horizontal pipe structure.

In other embodiments (not shown in the figure), the structure of the guardrail 200 can also be a non-tubular structure, for example: a solid structure, or a plate-like structure, or a layered structure, which is made up of multiple layers of materials, each layer can be different materials; it can also be other irregular shapes or curved arc structures and other desired structural shapes.

Figure 23:
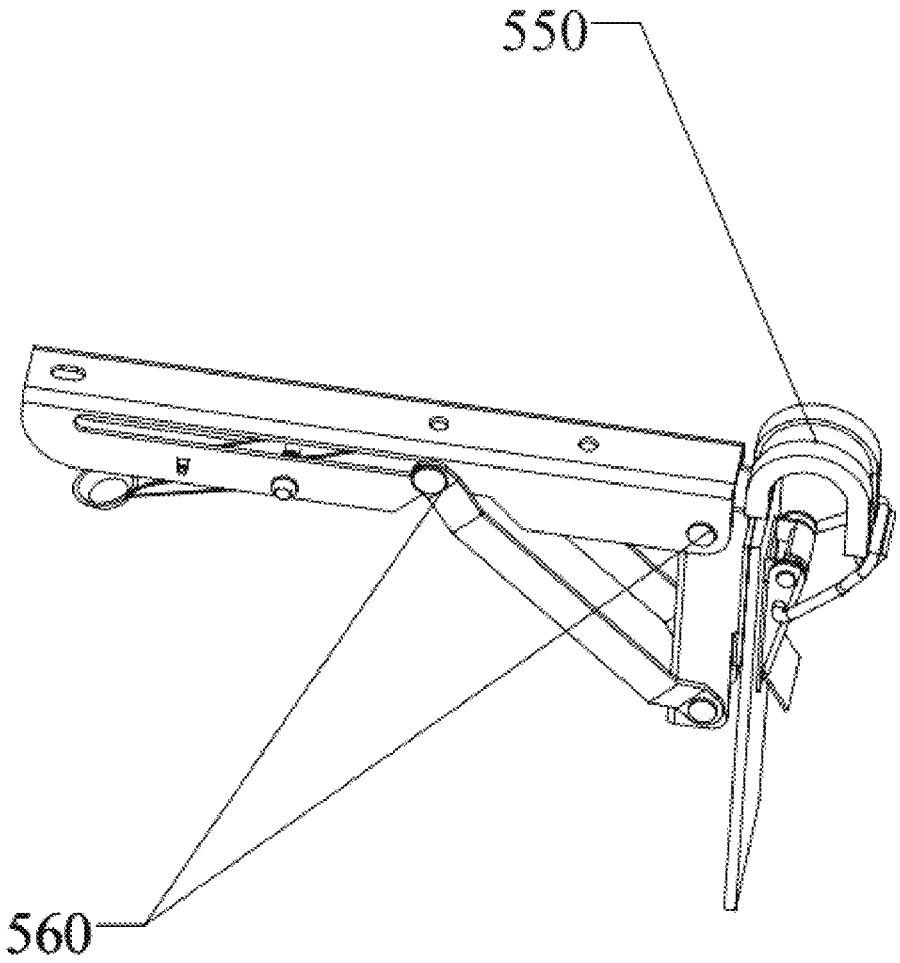
FIG. 23 is a schematic diagram of the rotating module of the present invention.

The rotary module 600 is connected to the guardrail 200 and the table board 300 respectively, the rotary module 600 includes at least one part with a curved surface, using a curved surface can enhance the rotary motion of the rotary module 600. Referring to FIG. 23, the rotary module 600 includes a rotating surface 550, the rotating surface 550 has a part of the arc structure, the rotation can be performed through the rotating surface 550. In other embodiments (as shown in FIG. 23), the arc structure of the rotary module 600 can also be a rotating structure 560. In other embodiments (not shown in the figure), the rotary module 600 can rotate through other different shapes, such as a spherical structure, as long as it achieves the corresponding effect, so that the overall structure can rotate.

Figure 22:
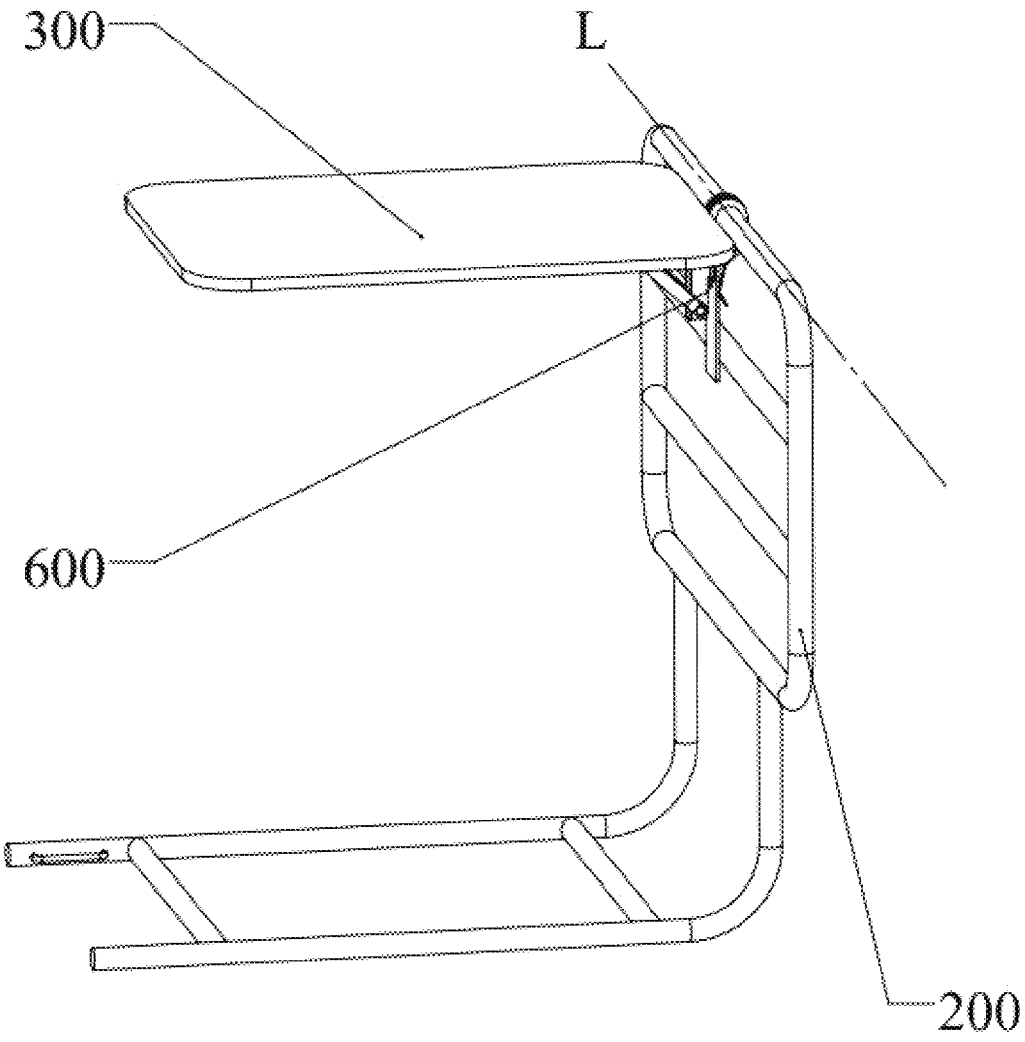
FIG. 22 is a schematic diagram of the bedside guardrail of the present invention.

The table board 300 can rotate around at least one rotary axis L through the rotary module 600, and the rotary module 600 can flip and move the table board 300 around at least one degree of freedom of rotation. As shown in FIG. 22, the direction of the rotary axis L is the direction of the dashed line in the figure, and the table board 300 flips around the rotary axis L. The direction of the rotary axis L is the same as the extension direction of the outer frame 220. The extension direction of the outer frame 220 is horizontal, and the extension direction is parallel to the blocking plane. In another embodiment (not shown in the figure), the extension direction of the outer frame 220 can also be vertical, and the extension direction is perpendicular or intersecting to the blocking plane.

In this embodiment, the table board 300 is connected to the top horizontal pipe 221 of the outer frame 220. In other embodiments (not shown in the figure), the table board 300 can be connected to any place on the outside of the outer frame 220, and rotate around the outer frame 220, as long as the final position of the table board surface 310 is the same as the direction of the bed body 100.

Figure 24:
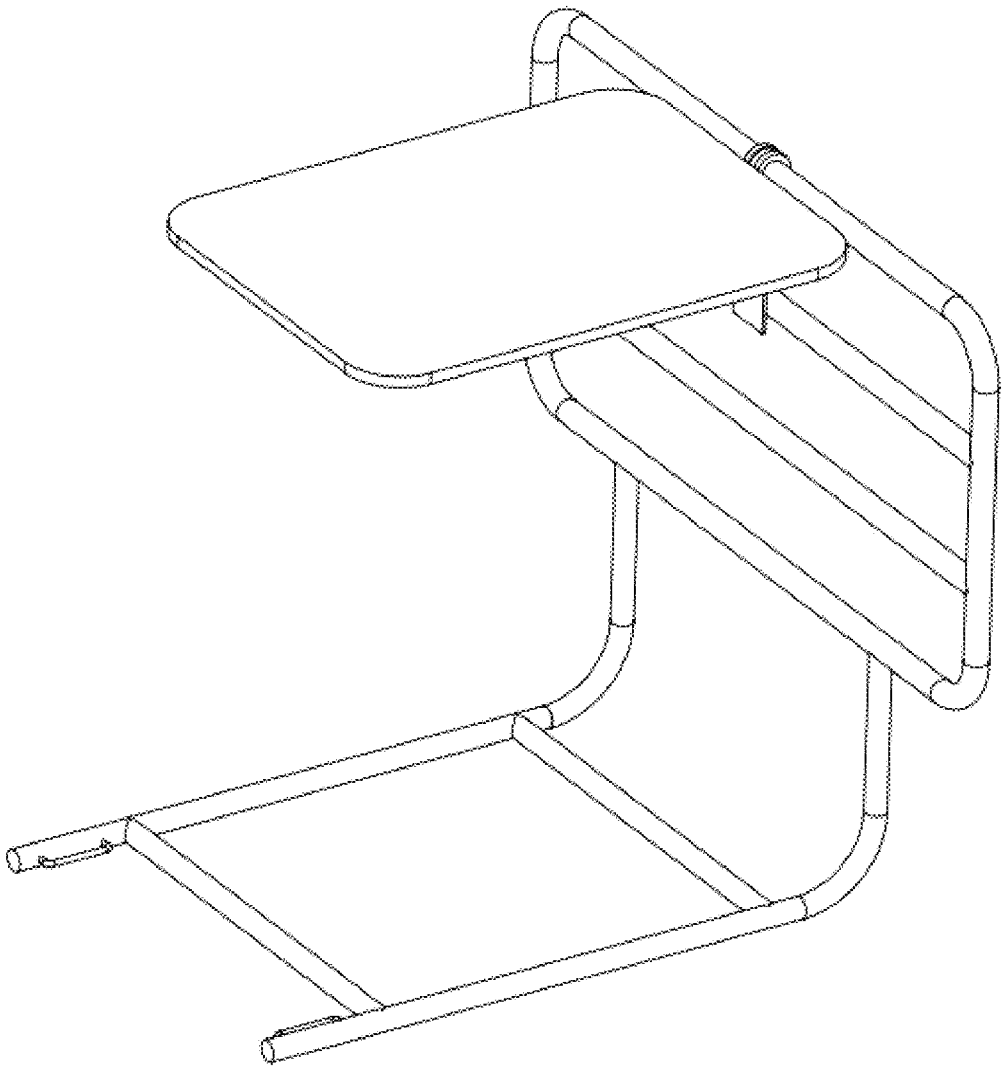
FIG. 24 is a schematic diagram when the table board of the present invention is in the first position.
Figure 25:
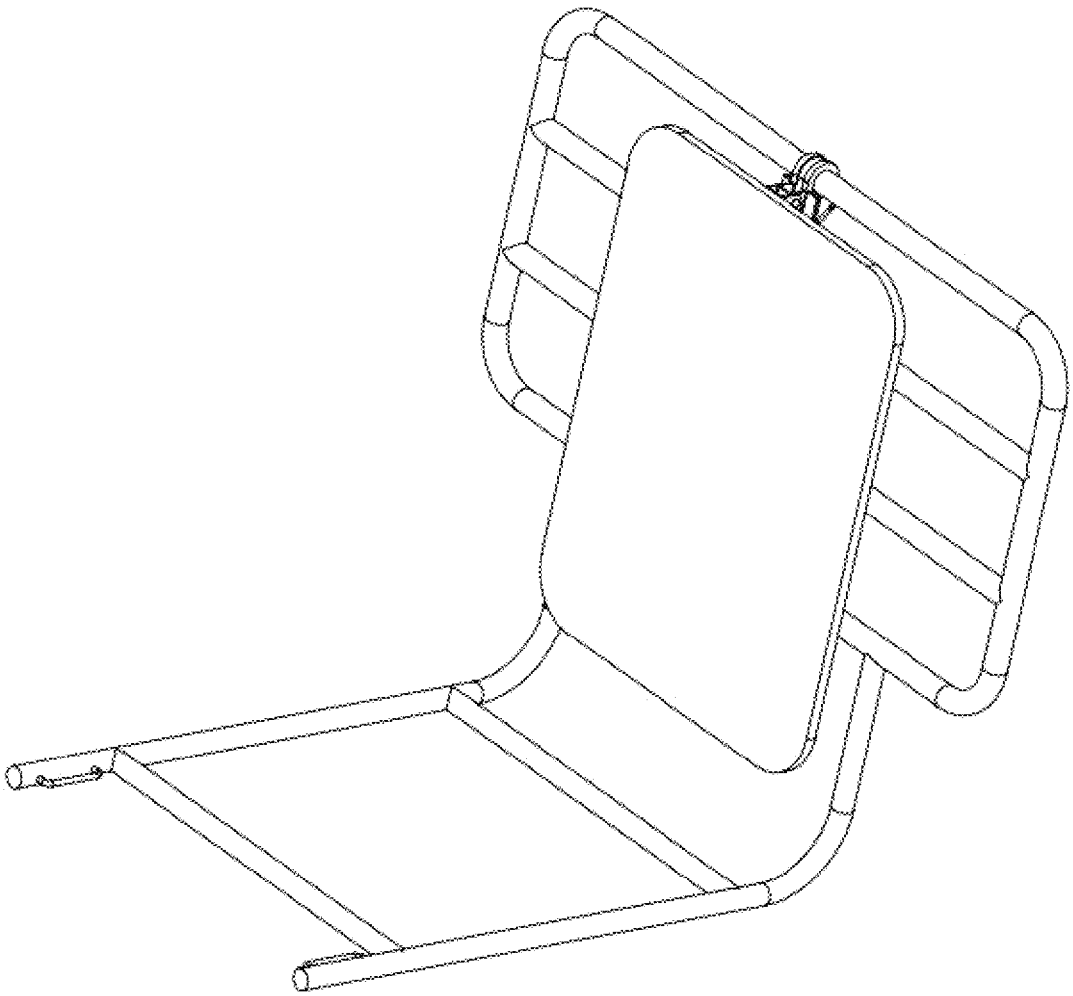
FIG. 25 is a schematic diagram when the table board of the present invention is in the second position.

Further, when the table board 300 rotates, the table board 300 has a first position and a second position. Referring to FIG. 24, when the table board 300 is in the first position, the table board surface 310 is basically parallel to the ground. Referring to FIG. 25, when the table board 300 is in the second position, the support direction of the table board surface 310 faces away from the bed body 100.

Figure 26:
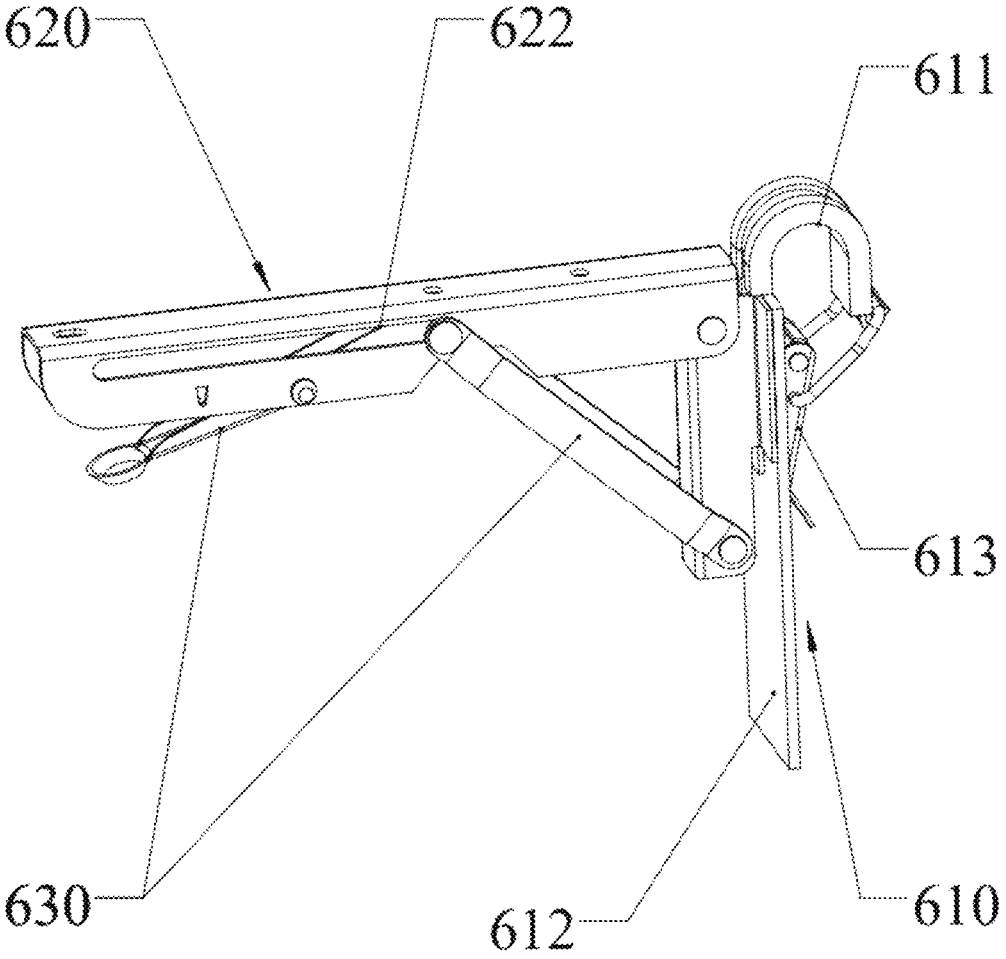
FIG. 26 is a schematic diagram of the rotating module of the present invention.
Figure 27:
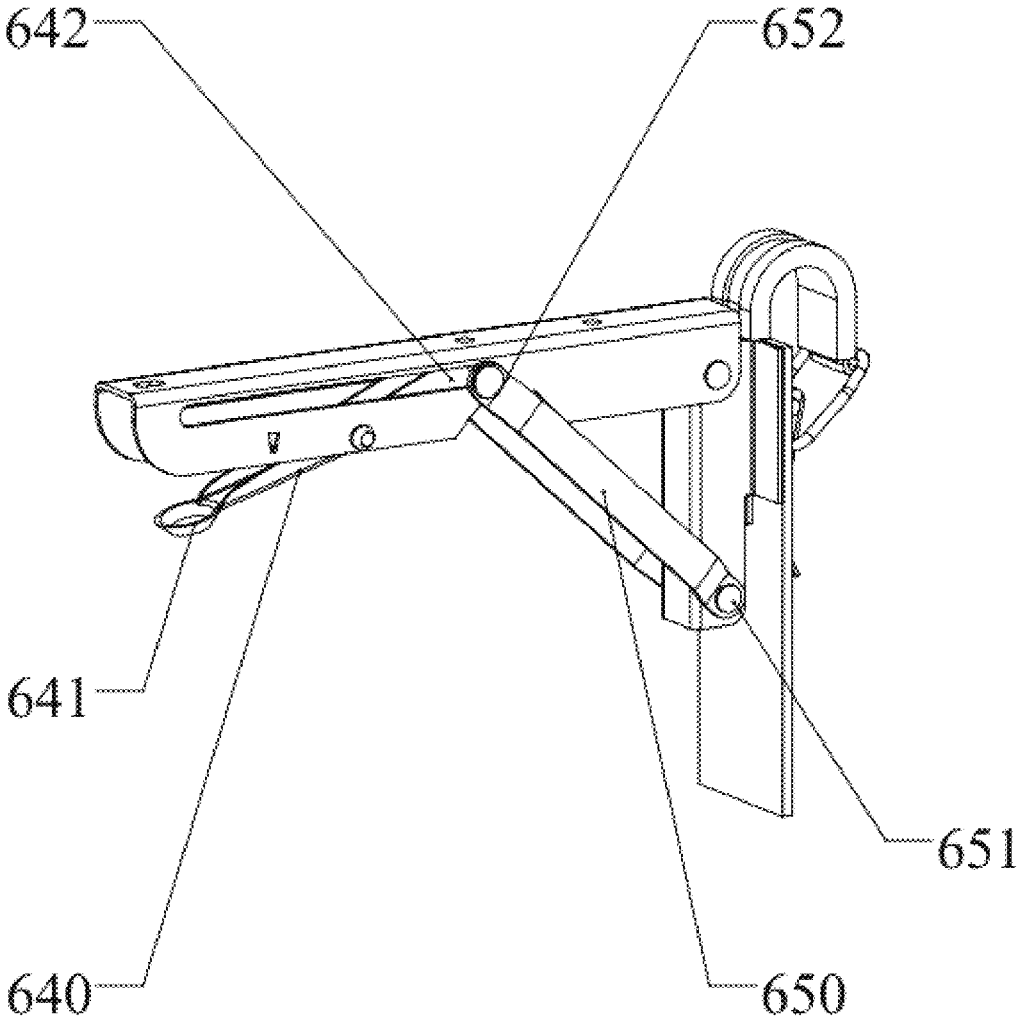
FIG. 27 is a schematic diagram of the rotating module of the present invention.

Referring to FIGS. 26 and 27, the rotary module 600 includes a guardrail connecting module 610 and a table top connecting module 620, the guardrail connecting module 610 includes a buckle part 611 and a limiting part 612, the table top connecting module 620 includes a cross bar 622.

In this embodiment, the cross bar 622 is fixedly connected to the bottom of the table board 300, the buckle part 611 is set on the outer frame 220, the limiting part 612 extends in a direction basically opposite to the support direction of the table board 300, that is, the limiting part 612 extends towards the surface of the bed body 100. When the table board 300 is in the first position, the buckle part 611 is buckled on the outer frame 220, for detachable connection. The limiting part 612 abuts on the inner extension arm 210, playing a limiting role.

Further, a threaded hole is set on the cross bar 622, and it is detachably connected to the table board 300 by means of threading. When the user needs to replace the table board 300, the table board 300 can be quickly replaced through this connection method. In some embodiments (not shown in the figure), the connection method between the cross bar 622 and the table board 300 can also be a buckle connection, or it can be a key connection.

In another embodiment (not shown in the figure), the connection method between the cross bar 622 and the table board 300 can be a plug-in method. Multiple holes are set on the surface of the cross bar 622, and a protruding column can be set at the bottom of the table board 300. The holes on the cross bar 622 are compatible with the protruding column, and the protruding column is plugged into the holes on the cross bar 622 to complete the connection and fixation.

Further, referring to FIG. 27, the guardrail connecting module 610 is rotatably engageable by the table top connecting module 620, and the rotary module 600 also includes at least one angle adjusting mechanism 630. The angle adjusting mechanism 630 is set between the guardrail connecting module 610 and the table top connecting module 620. The angle adjusting mechanism 630 can adjust the angle between the table top connecting module 620 and the guardrail connecting module 610, thereby helping the user to adjust the tilt angle of the table board surface 310 relative to the ground.

In this embodiment, the angle adjusting mechanism 630 includes a control device 640 and an adjusting rod 650. The adjusting rod 650 includes a locking end 651 and a free end 652. The control device 640 includes a control end 641 and a limiting end 642.

Further, the two ends of the adjusting rod 650 are respectively connected to the guardrail connecting module 610 and the table top connecting module 620. The locking end 651 can be rotatably engageable by the guardrail connecting module 610. The free end 652 can be slidably engageable by the table top connecting module 620. The limiting end 642 of the control device 640 is engageable by the adjusting rod 650. The limiting end 642 is used to limit the rotating tendency of the adjusting rod 650 in the sliding state, that is, when the adjusting rod 650 slides, there will be a relative rotation between the adjusting rod 650 and the guardrail connecting module 610, and the angle between the adjusting rod 650 and the guardrail connecting module 610 will change.

In this embodiment. The limiting end 642 allows the adjusting rod 650 to slide and rotate at a certain distance and limits the adjusting rod 650. The control end 641 is convenient for the user to control the control device 640 to adjust the angle adjusting mechanism 630. In this embodiment, the control end 641 is a device of the pressing structure, and the control device 640 is controlled by pressing the control end 641.

In other embodiments (not shown in the figure), the control method may include physical buttons, such as: joysticks, turntables, slide switches, touch switches, toggle switches, and joysticks, click wheels, etc. In some alternative embodiments (not shown in the figure), the control method can be coupled to any of the following (or not coupled): keyboard, infrared port, USB port and pointing device, such as a mouse. In some embodiments (not shown in the figure), the control method can also be an electronic device, such as a touch screen, computer device, and other control system devices.

Specifically, in this embodiment, a sliding groove is set on the table top connecting module 620, and the free end 652 of the adjusting rod 650 is engageable by the sliding groove. The angle between the table top connecting module 620 and the guardrail connecting module 610 can be changed by sliding inside the sliding groove, thereby realizing the rotation of the table board 300. When the free end 652 slides on the sliding groove, the adjusting rod 650 has a rotating tendency in the sliding state.

In other embodiments (not shown in the figure), the free end 652 of the adjusting rod 650 can adjust the angle in other ways, and is not limited to using the sliding groove method, for example: the card tongue moving method, or the gear transmission method, it can also be a slide rail movement method, or a transmission shaft transmission method and other sliding connection methods, as long as the adjusting rod 650 can change the angle between the table top connecting module 620 and the guardrail connecting module 610.

In another embodiment (not shown in the figure), the locking end 651 of the adjusting rod 650 can be rotatably engageable by the table top connecting module 620, and the free end 652 of the adjusting rod 650 can be slidably engageable by the guardrail connecting module 610. The control device 640 is engageable by the guardrail connecting module 610 and is used to control the angle between the table top connecting module 620 and the guardrail connecting module 610. When the free end 652 slides on the sliding groove, the adjusting rod 650 has a rotating tendency in the sliding state.

Figure 28:
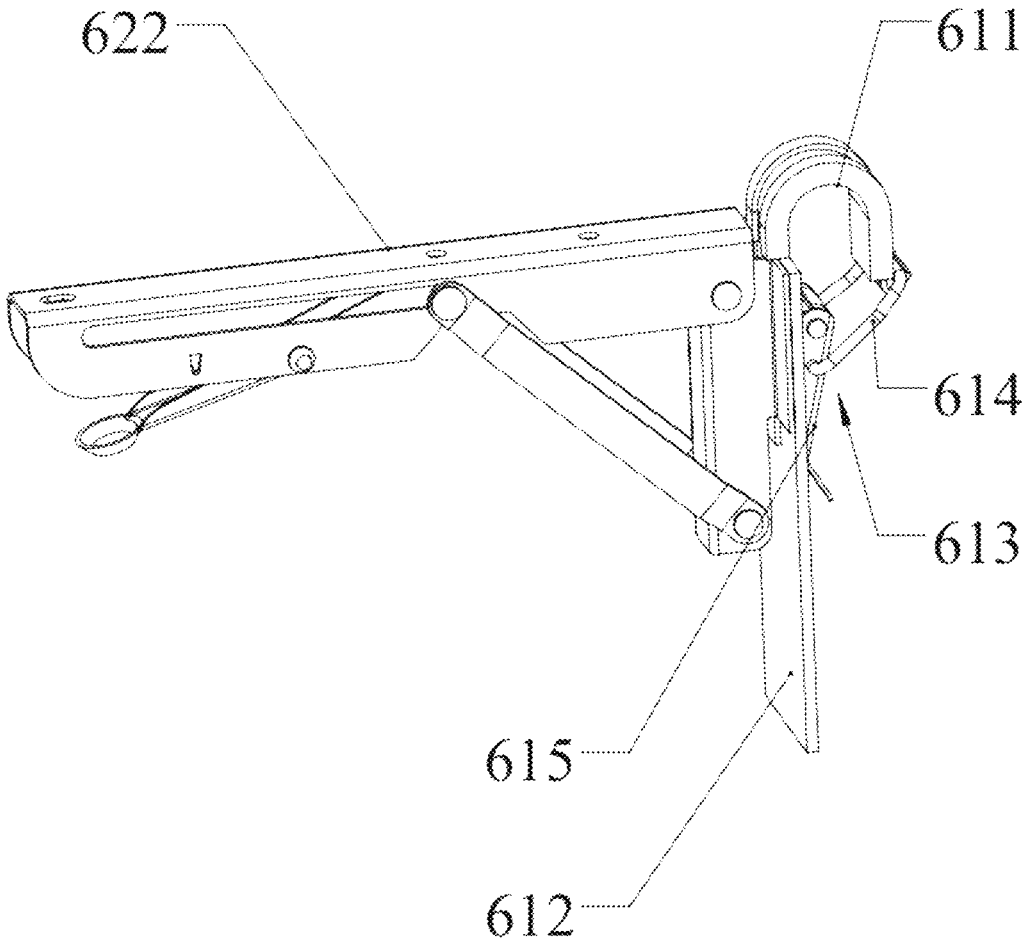
FIG. 28 is a schematic diagram of the rotating module of the present invention.

Further, referring to FIG. 28, in this preferred embodiment, a locking mechanism 613 is set on the limiting part 612, the locking mechanism 613 includes a locking member 614 and a switch 615, the locking member 614 is engageable by the buckle part 611, the switch 615 controls the opening and closing of the locking member 614 in order to fix the rotary module 600 on the outer frame 220.

In this embodiment, the locking member 614 and the switch 615 are respectively a ring and a toggle. In other embodiments (not shown in the figure), the locking member 614 can also be other structural parts, as long as the locking member 614 can be connected and fixed with the buckle part 611, at the same time, the switch 615 can also be a button, or a knob, or a key switch and other control switches.

Figure 29:
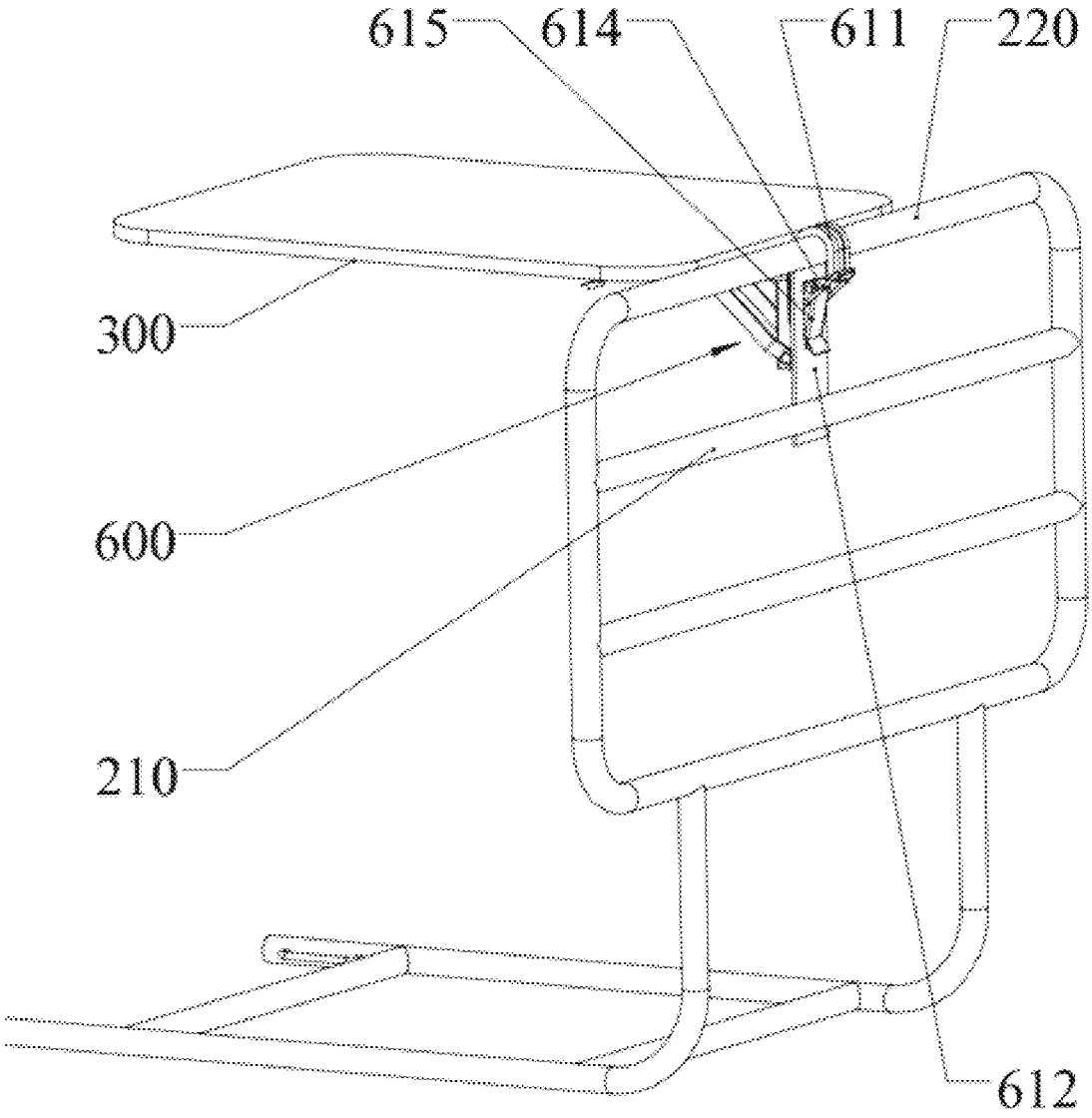
FIG. 29 is a schematic diagram of the bedside guardrail of the present invention.

Specifically, referring to FIG. 29, in this embodiment, when the rotary module 600 needs to be used, the table board 300 is fixed on the cross bar 622 of the table top connecting module 620, the cross bar 622 and the limiting part 612 of the guardrail connecting module 610 are fixedly connected in a vertical relationship. After the table board 300 is fixed on the cross bar 622, the limiting part 612 abuts on the inner extension arm 210 of the outer frame 220, plays a limiting role for the rotary module 600, fixes the rotary module 600 in the same position, then, through the buckle part 611 of the jointing device 660, the rotary module 600 is buckled on the outer frame 220, the shape of the outer frame 220 and the buckle part 611 are compatible. When the buckle part 611 is buckled on the outer frame 220, the locking mechanism 613 on the jointing device 660 will connect with the buckle part 611, the connection of the locking mechanism 613 and the buckle part 611 will form a closed space, the round pipe on the outer frame 220 is located in the closed space, thereby fixing the table board 300 on the guardrail 200. Thus, the user can start using the table board 300. After using the table board 300, the buckle part 611 is unlocked by the locking mechanism 613, and the jointing device 660 can be taken down from the guardrail 200 through the buckle part 611. The table board 300 can also be disassembled and separated from the jointing device 660. Thus, the various parts can be stored when not in use, increasing convenience.

Figure 30:
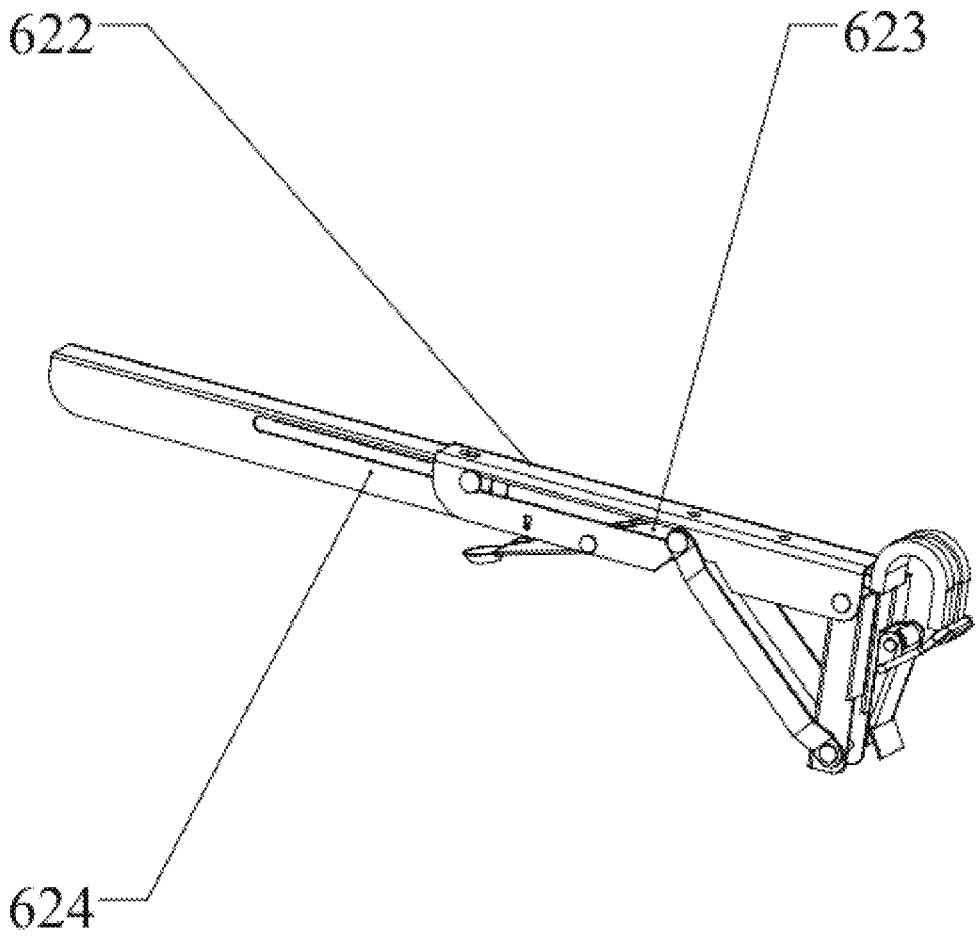
FIG. 30 is a schematic diagram of another embodiment of the rotating module of the present invention.

Referring to FIG. 30, in another embodiment, the guardrail connecting module 610 includes a cross bar 622 and an extension rod 624, wherein, the cross bar 622 has a storage cavity 623, and the extension rod 624 can be slidably set on the storage cavity 623. The extension rod 624 makes the guardrail connecting module 610 suitable for table boards 300 of different sizes.

Figure 31:
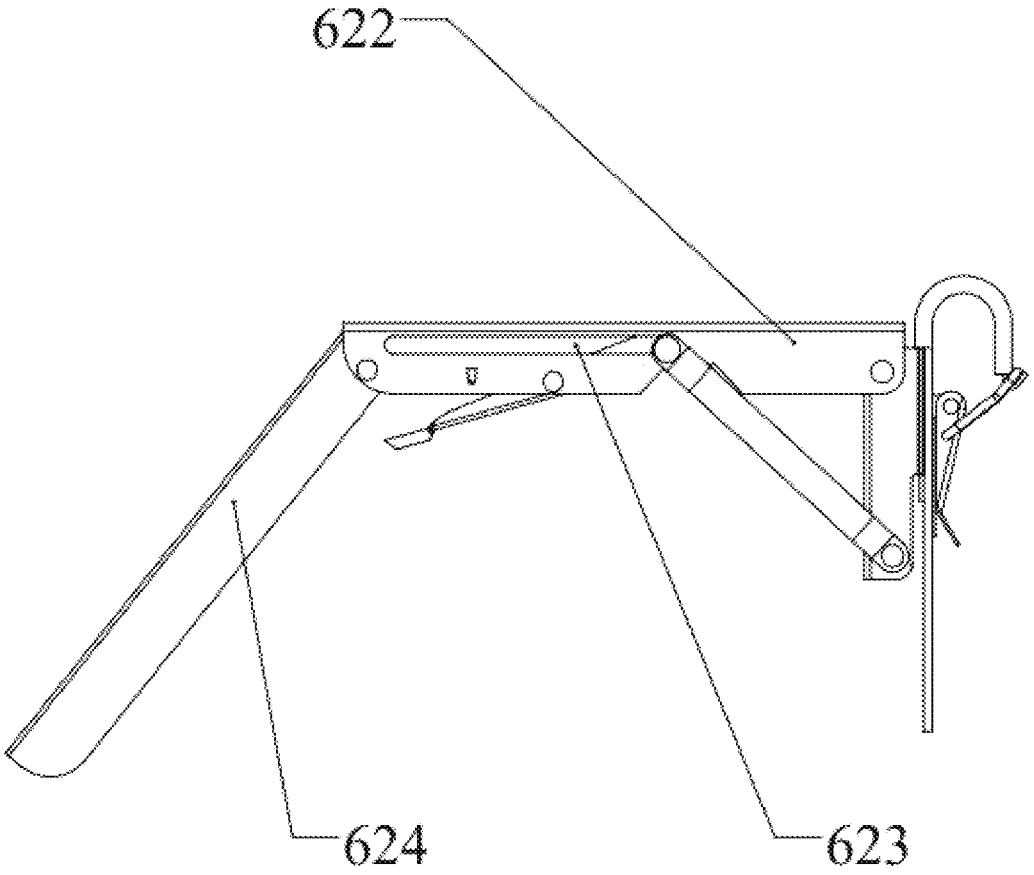
FIG. 31 is a schematic diagram of another embodiment of the rotating module of the present invention.

Referring to FIG. 31, in another embodiment, the guardrail connecting module 610 includes a cross bar 622 and an extension rod 624, wherein, the cross bar 622 has a storage cavity 623, and the extension rod 624 can be rotatably set on the storage cavity 623. At the same time, when the extension rod 624 extends out of the storage cavity 623, the extension rod 624 can rotate around the end of the cross bar 622, so as to realize the angle adjustment of the table board 300.

Figure 32:
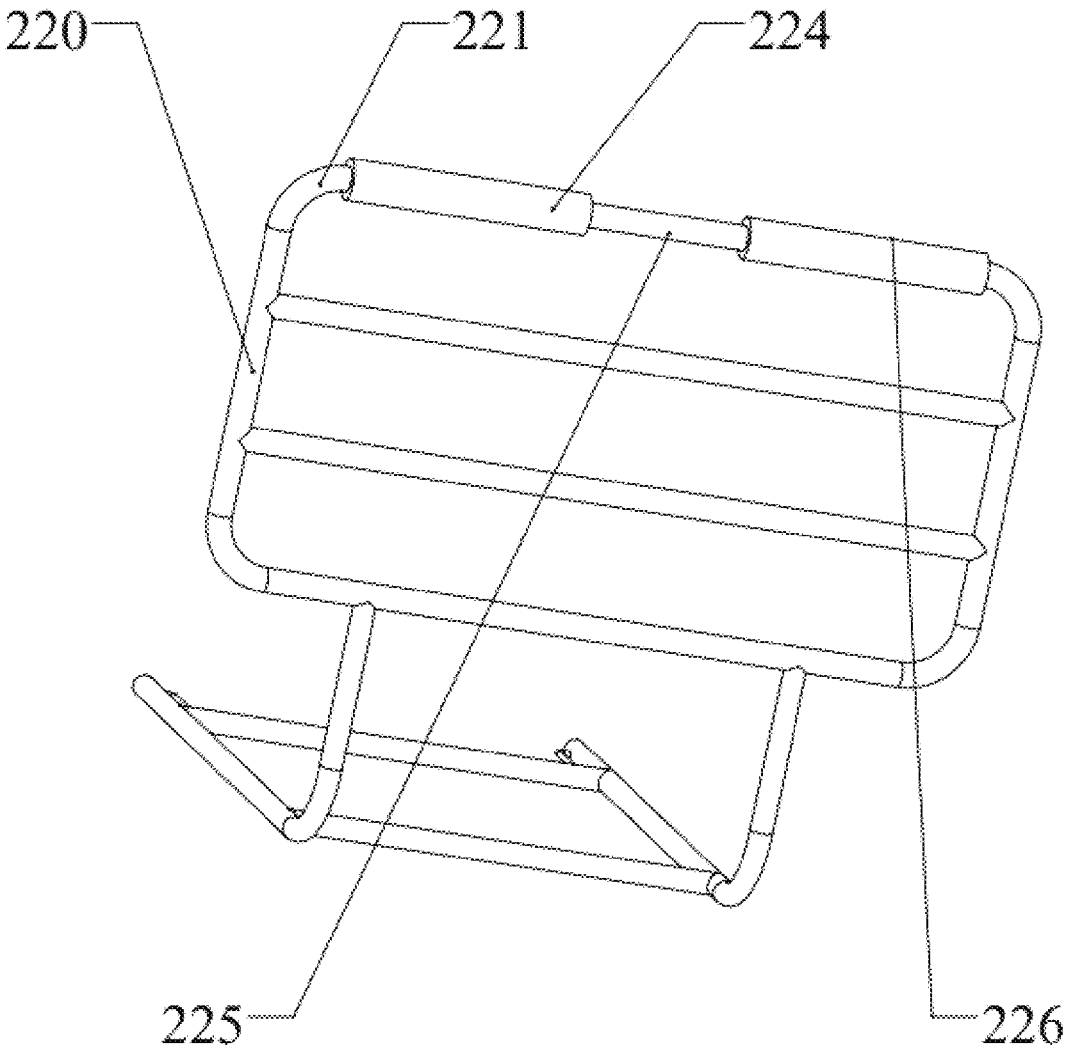
FIG. 32 is a schematic diagram of another embodiment of the horizontal pipe of the present invention.

Referring to FIG. 32, at least a part of the outer frame 220 has a cylindrical surface, the top horizontal pipe 221 of the outer frame 220 is divided into three sections, namely the first cross-pipe section 224, the second cross-pipe section 225 and the third cross-pipe section 226, wherein, the first cross-pipe section 224 and the third cross-pipe section 226 are respectively located at the two ends of the second cross-pipe section 225, the second cross-pipe section 225 is rotatable, in use, the table board 300 can be detachably fixed on the second cross-pipe section 225, the table board 300 can be rotated by the rotation of the second cross-pipe section 225. In this embodiment, the three cross-pipe sections are of a structure with a thin middle and thick ends, that is, the diameter of the first cross-pipe section 224 and the third cross-pipe section 226 is larger than the diameter of the second cross-pipe section 225. The horizontal pipe 221 is a tubular structure, and the table board 300 can rotate freely. In addition, in order to increase the stability of the table board 300, a screw or a fixing device can be added at the connection. In this way, even if the table rotates, the connection can remain firm.

Figure 33:
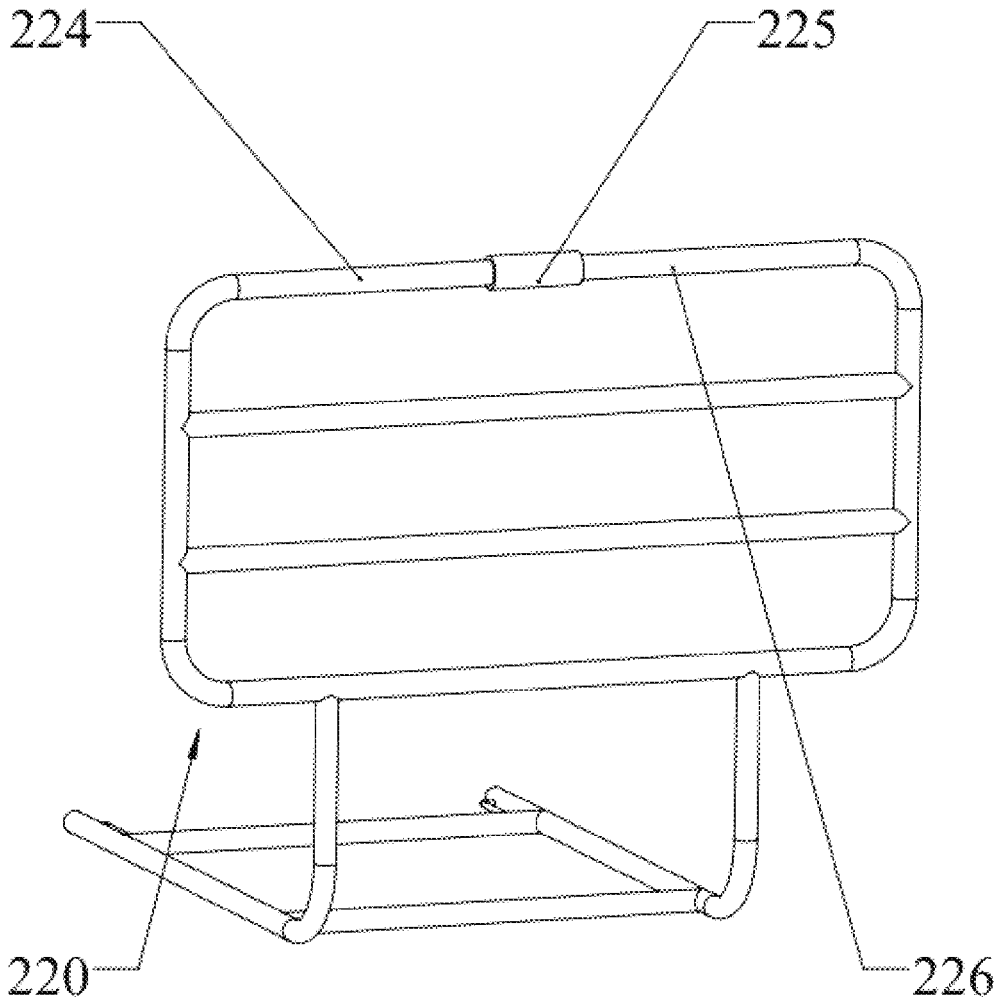
FIG. 33 is a schematic diagram of another embodiment of the horizontal pipe of the present invention.

In another embodiment, referring to FIG. 33, the three cross-pipe sections are of a structure with a thick middle and thin ends, that is, the diameter of the first cross-pipe section 224 and the third cross-pipe section 226 is smaller than the diameter of the second cross-pipe section 225.

In some embodiments (not shown in the figure), the table board 300 can move forward, backward, left, and right (this movement is parallel to the bed body 100), so that the table board 300 can be used at different positions. The movement of the table board 300 can be achieved in many ways, for example: one or more tracks can be installed under the table board 300, or there are one or more support points underneath, these support points can move, at the same time, a mobile bracket can also be set on the table board 300, this bracket can allow the table to move forward, backward, left, and right within a certain range, and the position of the table can be adjusted according to the needs of the user; or an electric motor and gears can be installed under the table board 300, and the movement of the table board 300 can be controlled by a remote control, thereby achieving precise position control; or air pressure rods can be installed at the four corners of the table board 300, and the height of the table board 300 can be controlled by adjusting the air pressure to achieve smooth movement of the table board 300; magnets can also be installed under the table board 300, and the table board 300 can be floated in the air by using magnetic force, and the movement of the table board 300 can be controlled by changing the polarity of the magnet.

In another embodiment (not shown in the figure), when the user is using the bedside guardrail, the table board 300 can adjust the height according to the user's height and comfortable position, so as to adapt to the user's table usage habits. The table board 300 can be set with a slide rail or a telescopic rod at the bottom, or a screw lift mechanism can be used, and the height of the table board 300 can be adjusted by rotating the handle, which is simple and practical; it can also be driven by an electric motor to drive the lifting mechanism, and the height of the table board 300 can be controlled by a remote control or a button, and the height of the table board 300 can also be adjusted by using an air pressure rod or an air bag to achieve smooth lifting of the table board 300; or a spring or a hydraulic cylinder can be used to adjust the height of the table board 300, and other lifting devices can also be used, these lifting devices can adjust the height of the table board 300.

As another preferred embodiment of this invention application, this invention application also provides a method for a user to dine in bed using a device, the method includes providing the device, the device includes a guardrail 200 and a table board 300 with a jointing device 660. The guardrail 200 includes an outer frame 220, the jointing device 66) can be detachably connected to the outer frame 220.

Further, the jointing device 66) and the table board 300 are detachably connected, in this embodiment, the table board 300 is fixed above the jointing device 660 by a fastener. At the same time, the jointing device 660 includes a buckle part 611 and a locking mechanism 613, the buckle part 611 is fixedly connected to the outer frame 220 by a buckle connection, the locking mechanism 613 can be engageable by the buckle part 611, thereby fixing the jointing device 660 on the guardrail 200.

Figure 34:
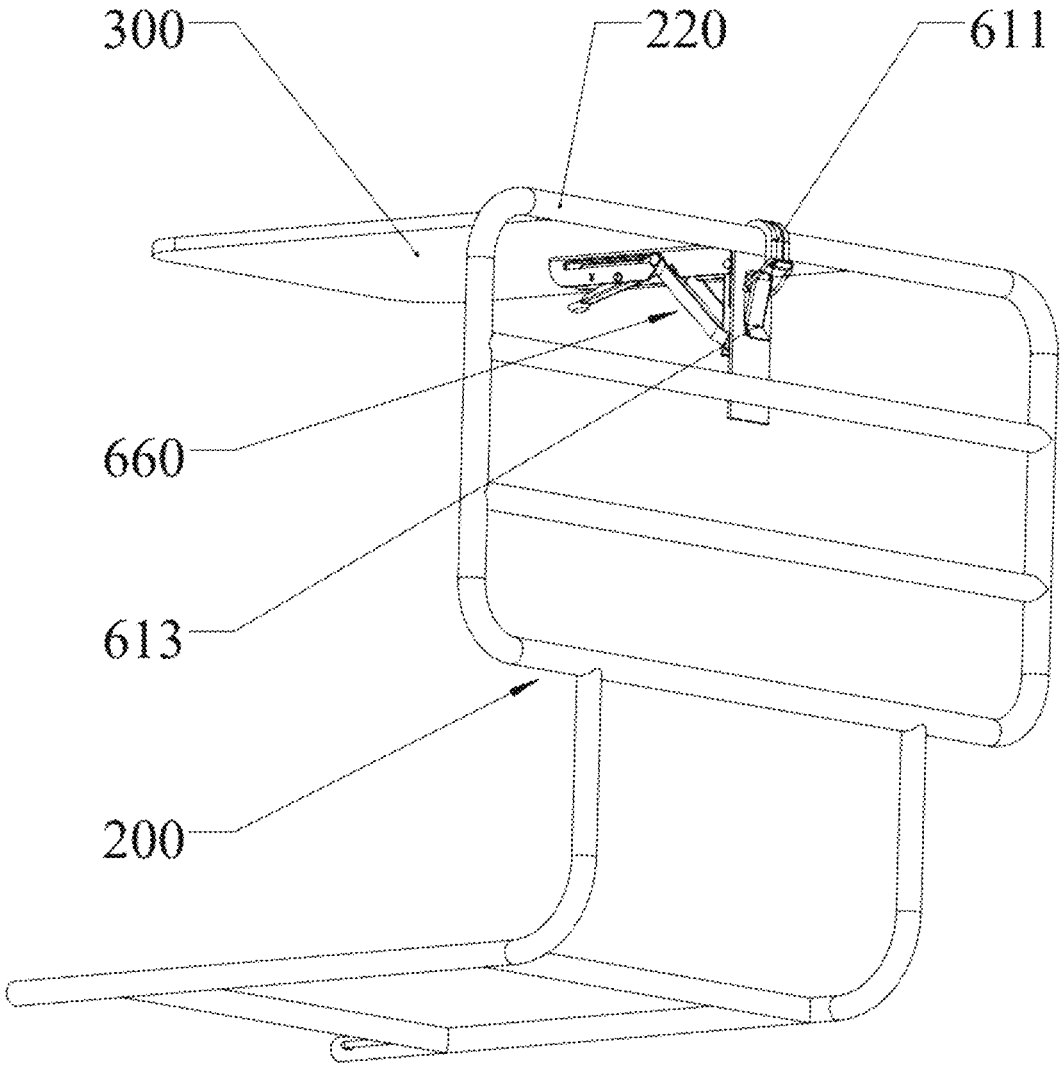
FIG. 34 is a schematic diagram of the bedside guardrail of the present invention.

Specifically, referring to FIG. 34, when the device needs to be used, first install the guardrail 200 on the bed body 100, and connect the jointing device 660 with the table board 300. Then, through the buckle part 611 on the jointing device 660, the jointing device 660 is buckled on the outer frame 220. The shape of the outer frame 220 and the buckle part 611 are compatible. After the buckle part 611 is buckled on the outer frame 220, the locking mechanism 613 on the jointing device 660 will connect with the buckle part 611, the connection of the locking mechanism 613 and the buckle part 611 will form a closed space, the round pipe on the outer frame 220 is located in the closed space, thereby fixing the table board 300 on the guardrail 200. Thus, the user can start using the table board 300.

After using the table board 300, the buckle part 611 is unlocked by the locking mechanism 613, and the jointing device 660 can be taken down from the guardrail 200 through the buckle part 611. The table board 300 can also be disassembled and separated from the jointing device 660. Thus, the various parts can be stored when not in use, increasing convenience.

Through the table board 300, the user can carry out daily work and life, for example: the user can eat through the table board 300; or study or work; it can also be leisure activities, such as playing board games, painting, making handicrafts, etc.; or personal care, such as makeup, manicure, etc.; it can also be computer operation, including writing documents, sending emails, online meetings, programming, etc.; or meetings, participating in team meetings or meetings with customers; it can also be reading and research, reading industry-related articles and reports, conducting market research and other daily life work behaviors.

The bedside guardrail with the folding table board provided by the present invention has a better protection and blocking function, can confine patients to the bed, and can be conveniently and quickly accommodated by nursing workers when the blocking function of the guardrail is not needed; in addition, the guardrail also has a dining table function, and can quickly provide a supporting platform when patients need to have meals in the bed, and meanwhile, the supporting platform is simple in structure and low in failure rate, which greatly facilitates the nursing work and the use of patients.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A bed guardrail with a folding table board, said bed guardrail comprises:

a guardrail, a table board and at least one rotary module; and wherein, said at least one rotary module is engageable by said guardrail and said table board, and facilitates said table board to rotate around at least one rotary axis, wherein, said at least one rotary module includes at least one part with a curved surface; and wherein, said guardrail includes an outer frame; and wherein, said at least one said-rotary axis is in the same direction as the extension direction of said outer frame, wherein, said table board has a relatively flat table board surface, said outer frame has an inner extension arm, wherein, said at least one rotary module includes a guardrail connecting module and a table top connecting module, wherein, said guardrail connecting module includes a buckle part and a limiting part, said table top connecting module includes a cross bar, wherein, said buckle part is set on said outer frame, said cross bar is fixedly connected to the bottom of said table board, wherein, when said table board is in use, said limiting part abuts on said inner extension arm, said limiting part extends in a direction basically opposite to the support direction of said table board.

2. The bed guardrail according to claim 1, wherein, said guardrail connecting module is rotatably engageable by said table top connecting module, said at least one rotary module also includes at least one angle adjusting mechanism, said at least one angle adjusting mechanism is engageable by setting between said guardrail connecting module and said table top connecting module, wherein, said at least one angle adjusting mechanism can-adjusts the angle between said table top connecting module and said guardrail connecting module, thereby helping the user to adjust the tilt angle of said table board surface relative to the ground.

3. The bed guardrail according to claim 2, wherein, said at least one angle adjusting mechanism includes a control device and at least one adjusting rod, wherein, said at least one adjusting rod includes a locking end and a free end, wherein, said locking end is rotatably engageable by said guardrail connecting module, said free end is slidably engageable by said table top connecting module.

4. The bed guardrail according to claim 3, wherein, said control device includes a control end and a limiting end, said limiting end is engageable by said at least one adjusting rod, to limit the rotating tendency of said at least one adjusting rod in the sliding state, said control end is convenient for the user to control said control device to adjust said at least one angle adjusting mechanism.

5. The bed guardrail according to claim 4, wherein, a locking mechanism is set on said limiting part, said locking mechanism includes a locking member and a switch, wherein, said locking member is engageable by said buckle part, said switch controls the opening and closing of said locking member in order to fix said at least one rotary module on said outer frame.

6. A method of using a device to achieve a user's daily work life on a bed, the method comprises the following steps:

provide the device, said device includes a guardrail and a table board with a jointing device; and wherein, said guardrail includes an outer frame; and wherein, said jointing device is detachably attached to said outer frame; and install said guardrail on the bed body; and install said table board on said outer frame; and use said device for daily work life, wherein, said jointing device is detachably attached to said table board, wherein, said jointing device includes a buckle part and a locking mechanism, said buckle part is buckled and installed on said outer frame, said locking mechanism is engageable by said buckle part, and limits said buckle part on said outer frame, so as to fix said jointing device on said guardrail.

* * * * *